US010162283B2

(12) United States Patent
Shimada et al.

(10) Patent No.: US 10,162,283 B2
(45) Date of Patent: Dec. 25, 2018

(54) IMAGE FORMING APPARATUS

(71) Applicants: Hiroyuki Shimada, Tokyo (JP); Toshiyuki Kabata, Kanagawa (JP); Takashi Fujita, Kanagawa (JP); Hiroshi Seo, Kanagawa (JP)

(72) Inventors: Hiroyuki Shimada, Tokyo (JP); Toshiyuki Kabata, Kanagawa (JP); Takashi Fujita, Kanagawa (JP); Hiroshi Seo, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/647,393

(22) Filed: Jul. 12, 2017

(65) Prior Publication Data

US 2018/0024462 A1 Jan. 25, 2018

(30) Foreign Application Priority Data

Jul. 25, 2016 (JP) ..... 2016-145552
May 9, 2017 (JP) ..... 2017-092804

(51) Int. Cl.

| | |
|---|---|
| ***G03G 15/05*** | (2006.01) |
| ***G03G 15/00*** | (2006.01) |
| ***G03G 15/06*** | (2006.01) |
| ***G03G 21/20*** | (2006.01) |
| ***H01T 23/00*** | (2006.01) |

(52) U.S. Cl.

CPC ..... *G03G 15/051* (2013.01); *G03G 15/065* (2013.01); *G03G 15/556* (2013.01); *G03G 21/206* (2013.01); *H01T 23/00* (2013.01); *G03G 15/5037* (2013.01); *G03G 15/65* (2013.01)

(58) Field of Classification Search

CPC .. G03G 15/051; G03G 15/065; G03G 15/556; G03G 15/65; G03G 15/5037; G03G 21/206; H01T 23/00

See application file for complete search history.

(56) References Cited

U.S. PATENT DOCUMENTS 5,456,782 A 10/1995 Fujita et al.
8,334,885 B2 * 12/2012 Tonami ..... G03G 21/206 347/123

(Continued)

FOREIGN PATENT DOCUMENTS

EP 2 378 379 A2 10/2011
JP 63-221823 A 9/1988

(Continued)

OTHER PUBLICATIONS

U.S. Appl. No. 07/966,508 filed Oct. 23, 1992.

(Continued)

*Primary Examiner* — Gregory H Curran
(74) *Attorney, Agent, or Firm* — Oblon, McClelland, Maier & Neustadt, L.L.P.

(57) ABSTRACT

An image forming apparatus includes an exhaust duct to guide air inside the image forming apparatus to an outside of the image forming apparatus. A positive ion generator emits a positive ion into the exhaust duct. A negative ion generator emits a negative ion into the exhaust duct. The negative ion generator is shifted from the positive ion generator in one of an air flow direction of the air moving inside the exhaust duct and a direction perpendicular to the air flow direction.

16 Claims, 35 Drawing Sheets

(56) References Cited

U.S. PATENT DOCUMENTS

| | | | | |
|---|---|---|---|---|
| 2005/0158075 | A1 | 7/2005 | Echigo et al. | |
| 2005/0232658 | A1 | 10/2005 | Kabata et al. | |
| 2006/0013624 | A1 | 1/2006 | Kurotaka et al. | |
| 2006/0257183 | A1 | 11/2006 | Ehara et al. | |
| 2008/0217556 | A1 | 9/2008 | Kagawa et al. | |
| 2008/0292347 | A1 | 11/2008 | Koide et al. | |
| 2011/0085819 | A1* | 4/2011 | Akagawa ..... | A61L 9/014 399/93 |
| 2011/0255895 | A1 | 10/2011 | Kim et al. | |
| 2017/0003633 | A1 | 1/2017 | Hase et al. | |
| 2017/0123357 | A1 | 5/2017 | Shimada et al. | |

FOREIGN PATENT DOCUMENTS

| | | |
|---|---|---|
| JP | 2008-251514 | 10/2008 |
| JP | 2010-185965 | 8/2010 |
| JP | 2010-204529 | 9/2010 |
| JP | 2012-74395 A | 4/2012 |
| JP | 2015-138248 | 7/2015 |
| JP | 2016-024428 | 2/2016 |

OTHER PUBLICATIONS

U.S. Appl. No. 08/423,046 filed Apr. 17, 1995.
"Test Method for the Determination of Emissions from Hardcopy Devices", RAL-UZ 171, Edition Jul. 2012, pp. 1-37. ( with English Translation).

* cited by examiner

IMAGE FORMING APPARATUS

CROSS-REFERENCE TO RELATED APPLICATIONS

This patent application is based on and claims priority pursuant to 35 U.S.C. § 119 to Japanese Patent Application Nos. 2016-145552, filed on Jul. 25, 2016, and 2017-092804, filed on May 9, 2017, in the Japanese Patent Office, the entire disclosure of each of which is hereby incorporated by reference herein.

BACKGROUND

Technical Field

Exemplary embodiments generally relate to an image forming apparatus, and more particularly, to an image forming apparatus for forming an image on a recording medium.

Background Art

Related-art image forming apparatuses, such as copiers, facsimile machines, printers, and multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a developing device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such image forming apparatus includes a positive ion generator and a negative ion generator. The positive ion generator emits a positive ion to an exhaust duct that guides air inside the image forming apparatus to an outside of the image forming apparatus. The negative ion generator emits a negative ion into the exhaust duct.

SUMMARY

This specification describes below an improved image forming apparatus. In one exemplary embodiment, the image forming apparatus includes an exhaust duct to guide air inside the image forming apparatus to an outside of the image forming apparatus. A positive ion generator emits a positive ion into the exhaust duct. A negative ion generator emits a negative ion into the exhaust duct. The negative ion generator is shifted from the positive ion generator in one of an air flow direction of the air moving inside the exhaust duct and a direction perpendicular to the air flow direction.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

Figure 1:
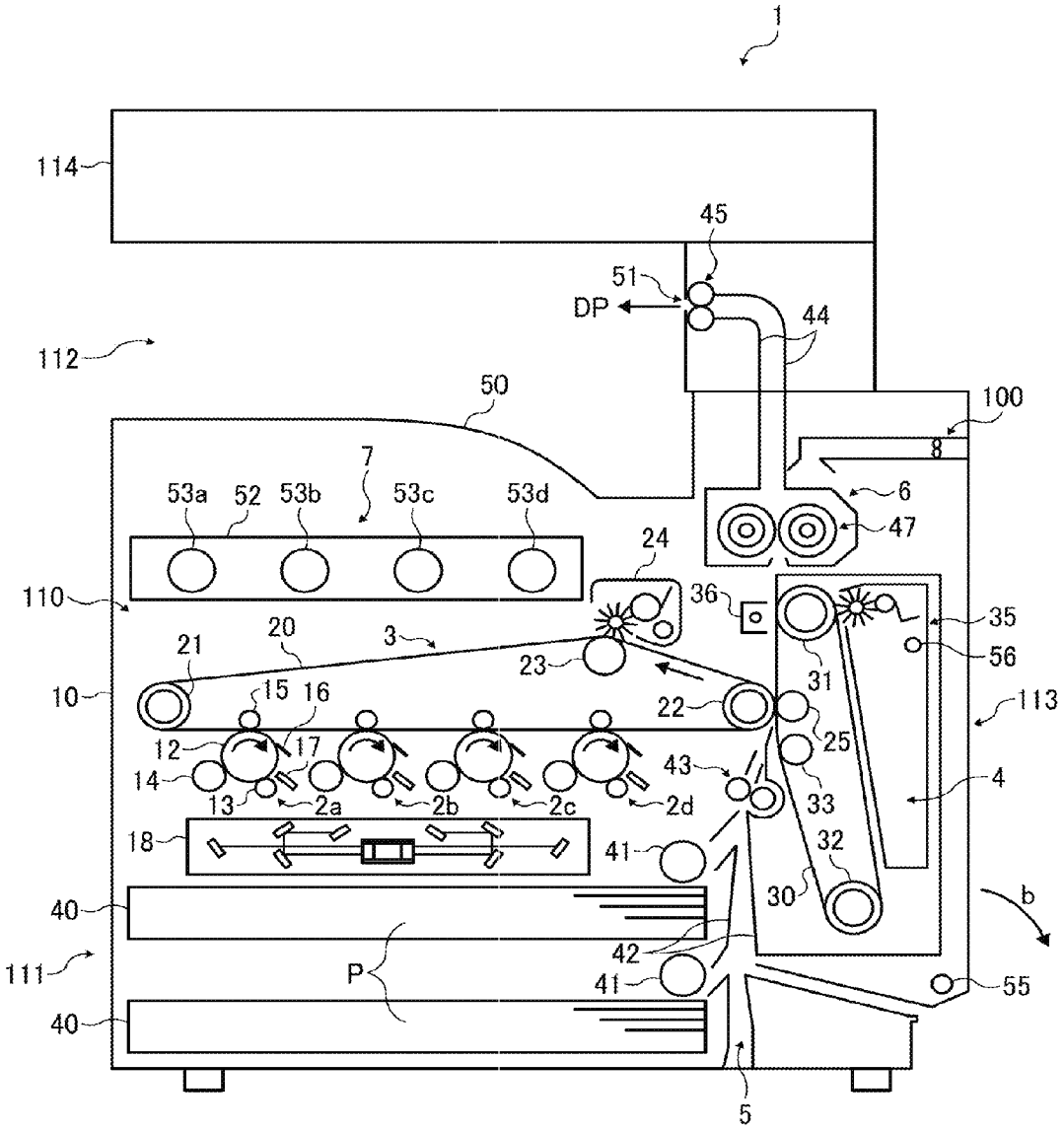
FIG. 1 is a schematic vertical cross-sectional view of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION OF THE DISCLOSURE

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

As used herein, the singular forms "a", "an", and "the" are intended to include the plural forms as well, unless the context clearly indicates otherwise.

Referring now to the drawings, wherein like reference numerals designate identical or corresponding parts throughout the several views, particularly to FIG. 1, an image forming apparatus 1 according to an exemplary embodiment is explained.

The image forming apparatus 1 may be a copier, a facsimile machine, a printer, a multifunction peripheral or a multifunction printer (MFP) having at least one of copying, printing, scanning, facsimile, and plotter functions, or the like. According to this exemplary embodiment, the image forming apparatus 1 is a color copier that forms a color toner image on a recording medium by electrophotography. Alternatively, the image forming apparatus 1 may be a monochrome copier that forms a monochrome toner image on a recording medium.

A description is provided of a construction of the image forming apparatus 1.

Figure 2:
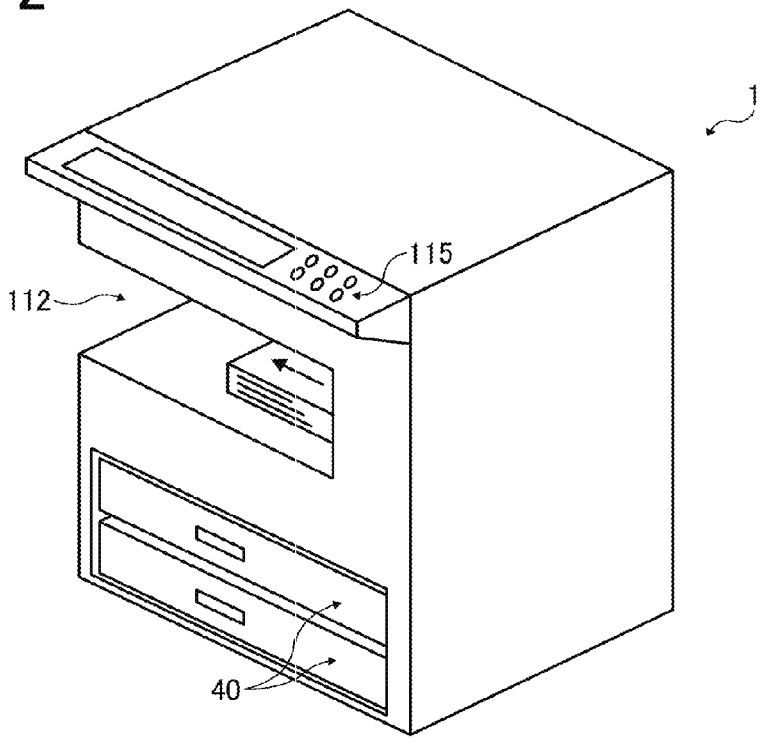
FIG. 2 is a perspective view of the image forming apparatus depicted in FIG. 1.
Figure 3:
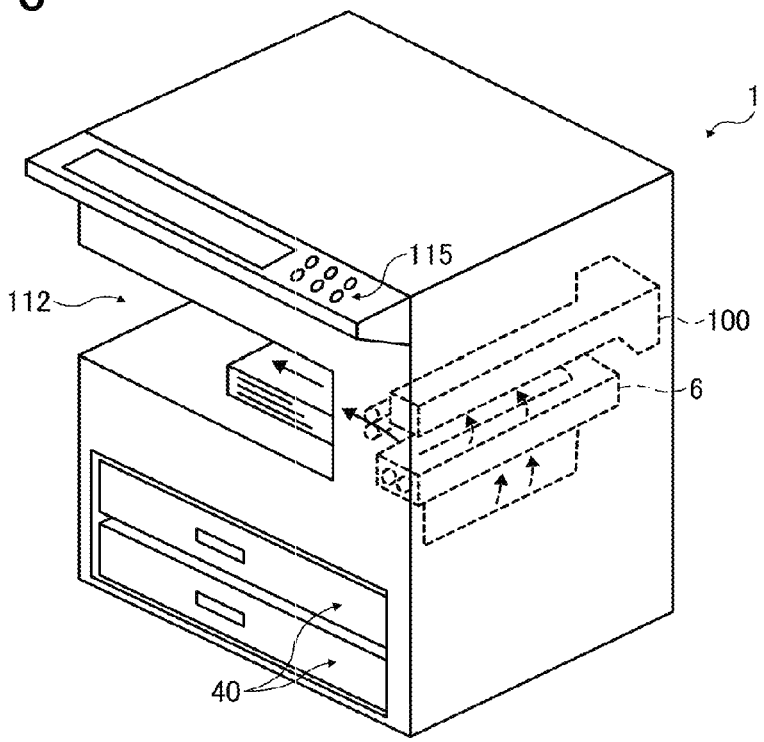
FIG. 3 is a perspective view of the image forming apparatus depicted in FIG. 2, illustrating a fixing device and an exhaust duct incorporated therein.

FIG. 1 is a schematic vertical cross-sectional view of the image forming apparatus 1 in its entirety. FIG. 2 is a perspective view of the image forming apparatus 1 in its entirety. FIG. 3 is a perspective view of the image forming apparatus 1, illustrating a fixing device 6 and an exhaust duct 100 incorporated therein.

As illustrated in FIG. 1, the image forming apparatus 1 includes an image forming portion 110 including four image forming devices 2*a*, 2*b*, 2*c*, and 2*d*, an intermediate transfer device 3, a secondary transfer device 4, a sheet conveyance device 5, the fixing device 6, and a toner supply device 7. Below the image forming portion 110 in FIG. 1 is a sheet feeder 111 serving as a recording medium feeder that includes a plurality of paper trays 40 each of which serves as a recording medium container that loads a plurality of sheets P serving as recording media. On the right of the image forming portion 110 in FIG. 1 is a duplex copy device 113. Above the image forming portion 110 in FIG. 1 is an image scanner 114. An internal output tray 112 is interposed between the image forming portion 110 and the image scanner 114. Components of the image forming portion 110 are disposed inside an outer cover 10.

A detailed description is now given of a construction of the image forming devices 2*a*, 2*b*, 2*c*, and 2*d*.

The four image forming devices 2*a*, 2*b*, 2*c*, and 2*d* form monochrome images in different colors, that is, yellow (Y), magenta (M), cyan (C), and black (K) toner images, with yellow, magenta, cyan, and black toners, respectively. Each of the image forming devices 2*a*, 2*b*, 2*c*, and 2*d* includes a photoconductor 12 serving as a latent image bearer that is rotatably supported and drum-shaped. The image forming portion 110 includes four photoconductors 12 aligned in tandem. In each of the image forming devices 2*a*, 2*b*, 2*c*, and 2*d*, the photoconductor 12 is surrounded by a charger 13, a developing device 14, a primary transfer roller 15 serving as a primary transferor, a photoconductor cleaner 16 serving as a latent image bearer cleaner, and a discharger 17.

Below the four image forming devices 2*a*, 2*b*, 2*c*, and 2*d* is an exposure device 18 serving as a latent image writer that is shared by the image forming devices 2*a*, 2*b*, 2*c*, and 2*d* and exposes an outer circumferential surface of each of the photoconductors 12 with laser beams. FIG. 1 illustrates reference numerals assigned to the components of the image forming device 2*a* that forms the yellow toner image. Similarly, each of the image forming devices 2*b*, 2*c*, and 2*d*, which form the magenta, cyan, and black toner images, respectively, includes components similar to those of the image forming device 2*a*.

The exposure device 18 includes a light source and optical parts such as a lens. The optical parts deflect a laser beam emitted from the light source toward the outer circumferential surface of the photoconductor 12 so that the laser beam optically scans the outer circumferential surface of the photoconductor 12, thus performing optical writing.

A detailed description is now given of a construction of the intermediate transfer device 3.

The intermediate transfer device 3 includes an intermediate transfer belt 20 serving as a belt-shaped primary transfer image bearer onto which the primary transfer rollers 15 primarily transfer the yellow, magenta, cyan, and black toner images formed by the image forming devices 2*a*, 2*b*, 2*c*, and 2*d*, respectively. The intermediate transfer device 3 further includes three support rollers, that is, a first support roller 21, a second support roller 22, and a third support roller 23, which support the intermediate transfer belt 20. The intermediate transfer belt 20 is looped around the first support roller 21, the second support roller 22, and the third support roller 23. The intermediate transfer belt 20 contacts the photoconductors 12 to form primary transfer nips therebetween. The intermediate transfer belt 20 is sandwiched between the photoconductors 12 and the primary transfer rollers 15 disposed opposite the photoconductors 12, respectively. The intermediate transfer belt 20 is surrounded by an intermediate transfer belt cleaner 24 and a secondary transfer roller 25 serving as a secondary transferor.

A detailed description is now given of a construction of the secondary transfer device 4.

The secondary transfer device 4 includes a secondary transfer belt 30 serving as a belt-shaped secondary transfer image bearer onto which the secondary transfer roller 25 secondarily transfers a color toner image formed by the yellow, magenta, cyan, and black toner images superimposed on the intermediate transfer belt 20 during duplex printing. The secondary transfer device 4 further includes three support rollers, that is, a first support roller 31, a second support roller 32, and a third support roller 33, which support the secondary transfer belt 30. The secondary transfer belt 30 is looped around the first support roller 31, the second support roller 32, and the third support roller 33. The secondary transfer belt 30 contacts the intermediate transfer belt 20 to form a predetermined secondary transfer nip between the intermediate transfer belt 20 and the secondary transfer belt 30. The secondary transfer belt 30 is sandwiched between the intermediate transfer belt 20 and the secondary transfer roller 25. The secondary transfer belt 30 is surrounded by a secondary transfer belt cleaner 35 and a back side image transfer device 36 that transfers the color toner image formed on the secondary transfer belt 30 onto a sheet P.

A detailed description is now given of a construction of the sheet feeder 111.

The sheet feeder 111 includes a first set of the paper tray 40 and a feed roller 41 and a second set of the paper tray 40 and a feed roller 41, which is layered on the first set vertically. Each of the paper trays 40 loads a plurality of sheets P. Each of the feed rollers 41 picks up and feeds an uppermost sheet P one by one from the paper tray 40.

A detailed description is now given of a construction of the sheet conveyance device 5.

The sheet conveyance device 5, serving as a recording medium conveyer, conveys the sheet P picked up from the sheet feeder 111 through a sheet conveyance path serving as a recording medium conveyance path that extends vertically upward in FIG. 1 and through the secondary transfer nip formed between the intermediate transfer device 3 and the secondary transfer device 4. The sheet conveyance device 5 includes feed guides 42, a registration roller pair 43, output guides 44, and an output roller pair 45.

The feed guides 42 guide the sheet P fed by the feed roller 41 toward a registration nip formed between two rollers of the registration roller pair 43. As a leading edge of the sheet P conveyed while guided by the feed guides 42 strikes the registration roller pair 43 at the registration nip, the registration roller pair 43 halts the sheet P and corrects skew of the sheet P. Thereafter, the registration roller pair 43 conveys the sheet P toward the secondary transfer nip at a time when another color toner image formed on an outer circumferential surface of the intermediate transfer belt 20 and the color toner image formed on an outer circumferential surface of the secondary transfer belt 30 reach the secondary transfer nip.

The output guides 44 guide the sheet P bearing the color toner images fixed on the sheet P by the fixing device 6 toward an outlet 51. The output roller pair 45 disposed at the outlet 51 ejects the sheet P conveyed while guided by the output guides 44 in a direction DP onto the internal output tray 112 situated outside the outer cover 10.

A detailed description is now given of a construction of the fixing device 6.

The fixing device 6 fixes the color toner images transferred from the intermediate transfer belt 20 and the secondary transfer belt 30 on the sheet P. The fixing device 6 fixes the color toner images on the sheet P under heat and pressure. The fixing device 6 includes a fixing roller pair 47 constructed of a pair of heating rollers.

A detailed description is now given of a construction of the toner supply device 7.

The toner supply device 7 supplies fresh toner to each of the four image forming devices 2*a*, 2*b*, 2*c*, and 2*d* with a powder pump or the like. The toner supply device 7 includes a toner storage 52 that accommodates toner cartridges 53*a*, 53*b*, 53*c*, and 53*d* that contain fresh yellow, magenta, cyan, and black toners, respectively.

The image forming apparatus 1 includes an exhaust duct 100 serving as an air outlet or a vent that exhausts peripheral air of the fixing device 6.

A description is provided of an image forming operation performed by the image forming apparatus 1 to form a color toner image on a front side and a back side of a sheet P.

A user places an original on an exposure glass of the image scanner 114 and presses a start key on a control panel 115 depicted in FIG. 2. Accordingly, the photoconductors 12, one of the first support roller 21, the second support roller 22, and the third support roller 23, which support the intermediate transfer belt 20, one of the first support roller 31, the second support roller 32, and the third support roller 33, which support the secondary transfer belt 30, the feed roller 41, and the like rotate at respective times.

In each of the four image forming devices 2*a*, 2*b*, 2*c*, and 2*d*, as the photoconductor 12 rotates clockwise in FIG. 1, the charger 13 uniformly charges the outer circumferential surface of the photoconductor 12. The exposure device 18 shared by the image forming devices 2*a*, 2*b*, 2*c*, and 2*d* performs writing with laser beams that irradiate the photoconductors 12, respectively, thus forming electrostatic latent images on the photoconductors 12. The developing devices 14 adhere yellow, magenta, cyan, and black toners to the electrostatic latent images on the outer circumferential surface of the respective photoconductors 12, visualizing the electrostatic latent images as yellow, magenta, cyan, and black toner images.

In the intermediate transfer device 3, one of the first support roller 21, the second support roller 22, and the third support roller 23, which support the intermediate transfer belt 20, drives and rotates the intermediate transfer belt 20. Accordingly, the intermediate transfer belt 20 drives and rotates the other two of the first support roller 21, the second support roller 22, and the third support roller 23. Thus, the intermediate transfer belt 20 rotates counterclockwise in FIG. 1 synchronously with rotation of the photoconductors 12. The primary transfer rollers 15 disposed opposite the photoconductors 12 via the intermediate transfer belt 20 are applied with a primary transfer bias that transfers the yellow, magenta, cyan, and black toner images formed on the outer circumferential surface of the respective photoconductors 12 onto the intermediate transfer belt 20 successively. The yellow, magenta, cyan, and black toner images are superimposed on the outer circumferential surface of the intermediate transfer belt 20 successively, thus forming a first full color toner image on the outer circumferential surface of the intermediate transfer belt 20. The first full color toner image is to be transferred onto the back side of the sheet P.

After the yellow, magenta, cyan, and black toner images are transferred onto the intermediate transfer belt 20, the photoconductor cleaners 16 remove residual toner failed to be transferred onto the intermediate transfer belt 20 and therefore remaining on the outer circumferential surface of the respective photoconductors 12 therefrom. The dischargers 17 discharge the outer circumferential surface of the respective photoconductors 12, initializing the surface potential thereof. Thereafter, the chargers 13 charge the photoconductors 12 again, respectively. The exposure device 18 writes electrostatic latent images on the photoconductors 12. The developing devices 14 develop the electrostatic latent images into yellow, magenta, cyan, and black toner images, respectively. Thus, the yellow, magenta, cyan, and black toner images are formed on the photoconductors 12 again, respectively.

In the secondary transfer device 4, one of the first support roller 31, the second support roller 32, and the third support roller 33, which support the secondary transfer belt 30, drives and rotates the secondary transfer belt 30. Accordingly, the secondary transfer belt 30 drives and rotates the other two of the first support roller 31, the second support roller 32, and the third support roller 33, thus rotating the secondary transfer belt 30 clockwise in FIG. 1 synchronously with rotation of the intermediate transfer belt 20. At the secondary transfer nip, the secondary transfer roller 25 disposed opposite the intermediate transfer belt 20 via the secondary transfer belt 30 is applied with a secondary transfer bias that transfers the first full color toner image formed on the outer circumferential surface of the intermediate transfer belt 20 onto the secondary transfer belt 30. The secondary transfer belt cleaner 35 pivots about a cleaner support shaft 56 to a non-cleaning position where the secondary transfer belt cleaner 35 is isolated from the secondary transfer belt 30.

In the intermediate transfer device 3, the intermediate transfer belt cleaner 24 electrostatically removes residual toner failed to be transferred onto the secondary transfer belt 30 after the first full color toner image is transferred onto the secondary transfer belt 30 and therefore remaining on the outer circumferential surface of the intermediate transfer belt 20 therefrom. Thereafter, the primary transfer rollers 15 transfer the yellow, magenta, cyan, and black toner images formed on the outer circumferential surface of the respective photoconductors 12 onto the outer circumferential surface of the intermediate transfer belt 20 again successively such that the yellow, magenta, cyan, and black toner images are superimposed on the intermediate transfer belt 20, thus forming a second full color toner image on the outer circumferential surface of the intermediate transfer belt 20. The second full color toner image is to be transferred onto the front side of the sheet P.

After the yellow, magenta, cyan, and black toner images that form the second full color toner image are transferred onto the intermediate transfer belt 20, the photoconductor cleaners 16 remove residual toner failed to be transferred onto the intermediate transfer belt 20 and therefore remaining on the outer circumferential surface of the respective photoconductors 12 therefrom. The dischargers 17 discharge the outer circumferential surface of the respective photoconductors 12, initializing the surface potential thereof for a next image forming cycle.

On the other hand, in the sheet feeder 111, one of the two feed rollers 41 is selectively rotated to pick up and feed a sheet P from the paper tray 40. In the sheet conveyance device 5, the feed guides 42 guide the sheet P sent from the sheet feeder 111 to the registration roller pair 43. As the leading edge of the sheet P strikes the registration roller pair 43 at the registration nip, the registration roller pair 43 halts the sheet P. The registration roller pair 43 starts rotation to feed the sheet P to the secondary transfer nip formed between the intermediate transfer belt 20 and the secondary transfer belt 30 at a time when the first full color toner image and the second full color toner image reach the secondary transfer nip.

At the secondary transfer nip, the secondary transfer roller 25 disposed opposite the back side of the sheet P is applied with the secondary transfer bias that transfers the second full color toner image formed on the outer circumferential surface of the intermediate transfer belt 20 onto the front side of the sheet P.

When the sheet P is conveyed upward slightly in FIG. 1 to an opposed portion where the back side image transfer device 36 is disposed opposite the secondary transfer belt 30, the back side image transfer device 36 applies a back side image transfer bias to the secondary transfer belt 30. The back side image transfer bias transfers the first full color toner image formed on the outer circumferential surface of the secondary transfer belt 30 onto the back side of the sheet P.

Thereafter, the sheet P bearing the first full color toner image on the back side of the sheet P and the second full color toner image on the front side of the sheet P is guided to the fixing device 6. As the sheet P passes through a fixing nip formed by the fixing roller pair 47 of the fixing device 6, the fixing roller pair 47 fixes the first full color toner image on the back side of the sheet P and the second full color toner image on the front side of the sheet P under heat and pressure. Thereafter, the output guides 44 guide the sheet P through a sheet conveyance path formed by the output guides 44. A path switching claw disposed in the sheet conveyance path changes destination of the sheet P. The output roller pair 45 ejects the sheet P onto an outside of the outer cover 10 through the outlet 51. The sheet P is stacked face down on a stack portion 50 of the internal output tray 112.

In the intermediate transfer device 3, the intermediate transfer belt cleaner 24 removes residual toner failed to be transferred onto the sheet P after the second full color toner image is transferred onto the sheet P and therefore remaining on the outer circumferential surface of the intermediate transfer belt 20 therefrom.

In the secondary transfer device 4, the secondary transfer belt cleaner 35 removes residual toner failed to be transferred onto the sheet P after the first full color toner image is transferred onto the sheet P and therefore remaining on the outer circumferential surface of the secondary transfer belt 30 therefrom. The secondary transfer belt cleaner 35 at the non-cleaning position when the first full color toner image is transferred from the intermediate transfer belt 20 onto the secondary transfer belt 30 pivots about the cleaner support shaft 56 to a cleaning position where the secondary transfer belt cleaner 35 contacts the secondary transfer belt 30.

Thus, the intermediate transfer belt cleaner 24 and the secondary transfer belt cleaner 35 remove the residual toner from the outer circumferential surface of the intermediate transfer belt 20 and the secondary transfer belt 30, respectively, so that the intermediate transfer belt 20 and the secondary transfer belt 30 are ready for a next image bearing.

If one of the developing devices 14 suffers from shortage of toner due to the image forming operation, the corresponding one of the toner cartridges 53*a*, 53*b*, 53*c*, and 53*d* in the toner storage 52 of the toner supply device 7 supplies fresh toner in a corresponding color to the developing device 14 by conveying the fresh toner with the powder pump or the like. If the sheet P is jammed and is not conveyed, the duplex copy device 113 pivots about a duplex copy device support shaft 55 in a direction b in FIG. 1. Thus, the sheet conveyance path is opened to allow the user to remove the jammed sheet P.

When the image forming apparatus 1 receives a print job to form a full color toner image on one side of a sheet P, yellow, magenta, cyan, and black toner images formed on the outer circumferential surface of the respective photoconductors 12 of the four image forming devices 2*a*, 2*b*, 2*c*, and 2*d* are transferred onto the outer circumferential surface of the intermediate transfer belt 20, thus forming a full color toner image on the intermediate transfer belt 20. The full color toner image is transferred onto one side of the sheet P conveyed through the sheet conveyance device 5 without being transferred onto the secondary transfer belt 30 of the secondary transfer device 4. The fixing device 6 fixes the full color toner image on the sheet P. The sheet P is stacked face down on the stack portion 50 of the internal output tray 112. If the image forming apparatus 1 receives a print job to print on a plurality of sheets P, the plurality of sheets P is collated and aligned on the stack portion 50.

When the image forming apparatus 1 receives a print job to form a monochrome toner image or a bicolor toner image on a sheet P, one or more of the corresponding image forming devices 2*a*, 2*b*, 2*c*, and 2*d* are activated to form a toner image. The toner image is transferred onto a sheet P via the intermediate transfer belt 20 of the intermediate transfer device 3 and the secondary transfer belt 30 of the secondary transfer device 4.

In environment-sensitive countries, for example, in countries in Europe, various accreditation criteria relating to substances which may generate during image formation such as volatile organic compounds (VOC), ozone, dust, fine particles, and ultra fine particles are applied to image forming apparatuses that form toner images by electrophotography such as a copier, a printer, and an MFP. The government research institution in Germany has introduced the ecolabel called the Blue Angel Mark (BAM). Certified products and services are allowed to use the ecolabel.

In order to attain a certification for the BAM, products and services are required to pass various tests, one of which is a test for ultra fine particles (UFP) introduced in 2013.

The BAM provides an emission test. The following describes a method of the emission test schematically. An image forming apparatus is located in an emission test room ventilated under a predetermined condition. The image forming apparatus is activated continuously for 10 minutes under control from an outside of the test room. Measurement is performed in a standby state and an operation state of the image forming apparatus.

Measurement of the UFP is performed with a specified aerosol measurement instrument connected to the test room to count particles. The aerosol measurement instrument measures the particle diameter and the number of particles. For example, the Fast Mobility Particle Sizer 3091 (FMPS™) spectrometer available from TSI Inc. is used as the aerosol measurement instrument.

Under the BAM standard, the Fast Mobility Particle Sizer 3091 (FMPS™) measures the UFP of the size in a range of from 5.6 [nm] to 560 [nm], which generates from the image forming apparatus. The BAM standard requests the number of the UFPs to be smaller than $3.5\times10^{11}$ per 10 minutes. The BAM standard concerns the number of the UFPs generated in 10 minutes and does not concern the mass of the UFP.

If dust is circular in cross-section, for example, dust having a diameter of about 1 [μm] or greater is measured in a weight measuring method. The BAM standard uses weight [mg/h] as unit. Air is collected from the test room for a predetermined time after the image forming apparatus is started. The air is filtered through a glass fiber filter by a pump. The volume [$m^3$] of the air sucked by the filter is measured. Differential measurement is performed for the filter. The absolute weight [μg] of dust is measured based on differential weighing of the filter. The density of dust [$\mu g/m^{-3}$] inside the test room and the emission rate [$\mu g/h^{-1}$] peculiar to the image forming apparatus are calculated based on both values. Hence, the calculation result is represented by the weight of all particles collected regardless of the size of the particle. The above is extracted from the document of the BAM standard RAL-UZ171.

The VOC is an organic compound emitted from a testing object and detected in air inside the test room. In the test method, the VOC is defined as a defined organic compound and an undefined organic compound, which are eluted between n-hexane and n-hexadecane on a nonpolar column under separation by gas chromatography, and a compound of those substances. The VOC is measured by collecting air from the test room and filtering the air through a Tenax TA tube with a pump. Thereafter, analysis is performed by gas chromatography-mass spectrometry (GC/MS) or the like.

The UFPs generate from various components of the image forming apparatus. However, even when only a fixing device of the image forming apparatus starts and heats, an amount of generation of the UFPs increases substantially. Hence, the fixing device is one of origins of the UFPs. In order to decrease a total amount of the UFPs emitted from the image forming apparatus, a target temperature of the fixing device as the origin of the UFPs to which the fixing device is heated may be decreased. However, it may be difficult to decrease the target temperature of the fixing device excessively to achieve fixing quality to fix a toner image on a sheet properly.

If a weight of the dust and the VOC is greater than the standard, since the standard is defined in weight, a total amount of the dust and the VOCs emitted from the image forming apparatus is required to decrease regardless of the particle diameter. For example, a plurality of solutions is established by changing parts that generate the dust and the VOCs, attaching a filter to an outlet of the image forming apparatus, and the like. However, the UFP is small in the particle diameter and slight in the generation amount compared to the VOC, for example, one thousandth or less of that of the VOC. Accordingly, it is difficult to identify a component of the UFP. Consequently, a method for reducing the UFPs effectively is barely found except for lowering the target temperature of the fixing device. Even if the UFP is filtered through the filter like the dust and the VOC, since the UFP has a small particle diameter in a range of from 5.6 [nm] to 560 [nm] as described above, the UFP readily slips through a conventional filter having a rough mesh of several microns or greater and escapes from collection. An electrostatic filter attains an improved collection rate for collecting the UFPs. However, the electrostatic filter is expensive, making it difficult to be installed in a low cost product. Thus, it is difficult for the image forming apparatus to meet the BAM standard for the amount of generation of the UFPs with a normal filter only.

As described above, the UFP generated by the image forming apparatus is produced as a substance volatilized as gas and aggregated into a fine particle. As aggregation is facilitated and the size of a particle composing the UFP increases, a rate of particles having a great particle diameter increases. The BAM standard defines the number of the UFPs emitted per 10 minutes. Accordingly, even if the total amount of generation of the UFPs, that is, the total weight of the UFPs, is identical, if the size of the UFP increases, the number of the UFPs under the definition of the BAM standard decreases. For example, as the particle diameter of the UFP is doubled, the number of the UFPs decreases to one eighth. As the particle diameter of the UFP increases, the UFP adheres to a surface of the image forming apparatus, a peripheral floor of the image forming apparatus, and the like with an increased adhesive force. The UFP is collected by the filter at an increased rate. The UFP increases an amount of retention of electric charge, thus being electrically attracted readily. Thus, fine particles emitted from the image forming apparatus are not diffused easily to surroundings of the image forming apparatus.

A description is provided of a configuration of the image forming apparatus 1, which decreases the number of the UFPs emitted from the image forming apparatus 1 by aggregating the UFPs effectively.

A description is provided of a plurality of embodiments of an exhauster installed in the image forming apparatus 1.

First, a description is provided of a construction of an exhauster 61 according to a first embodiment.

Figure 4A:
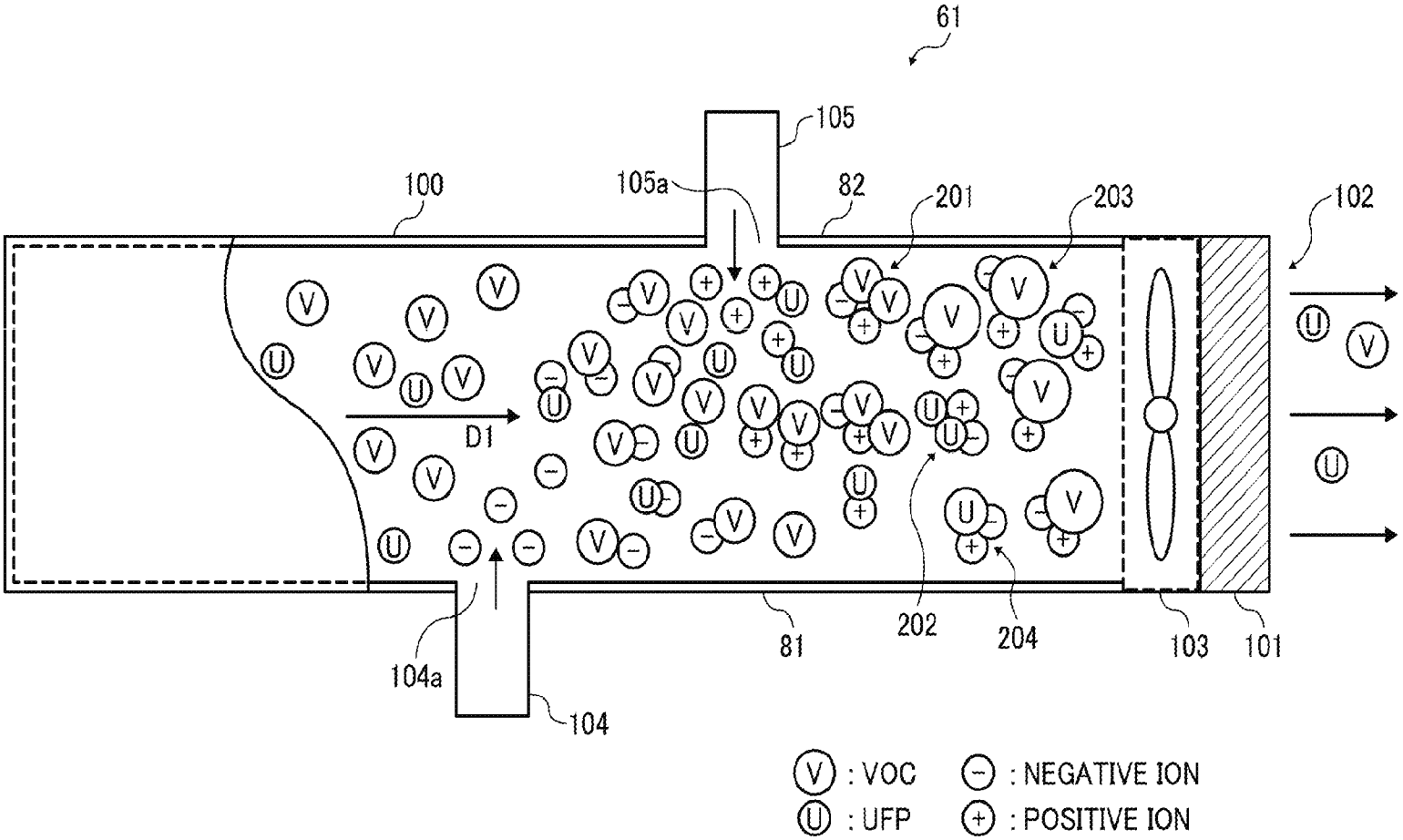
FIG. 4A is a plan view of an exhauster according to a first embodiment, which is incorporated in the image forming apparatus depicted in FIG. 1.
Figure 4B:
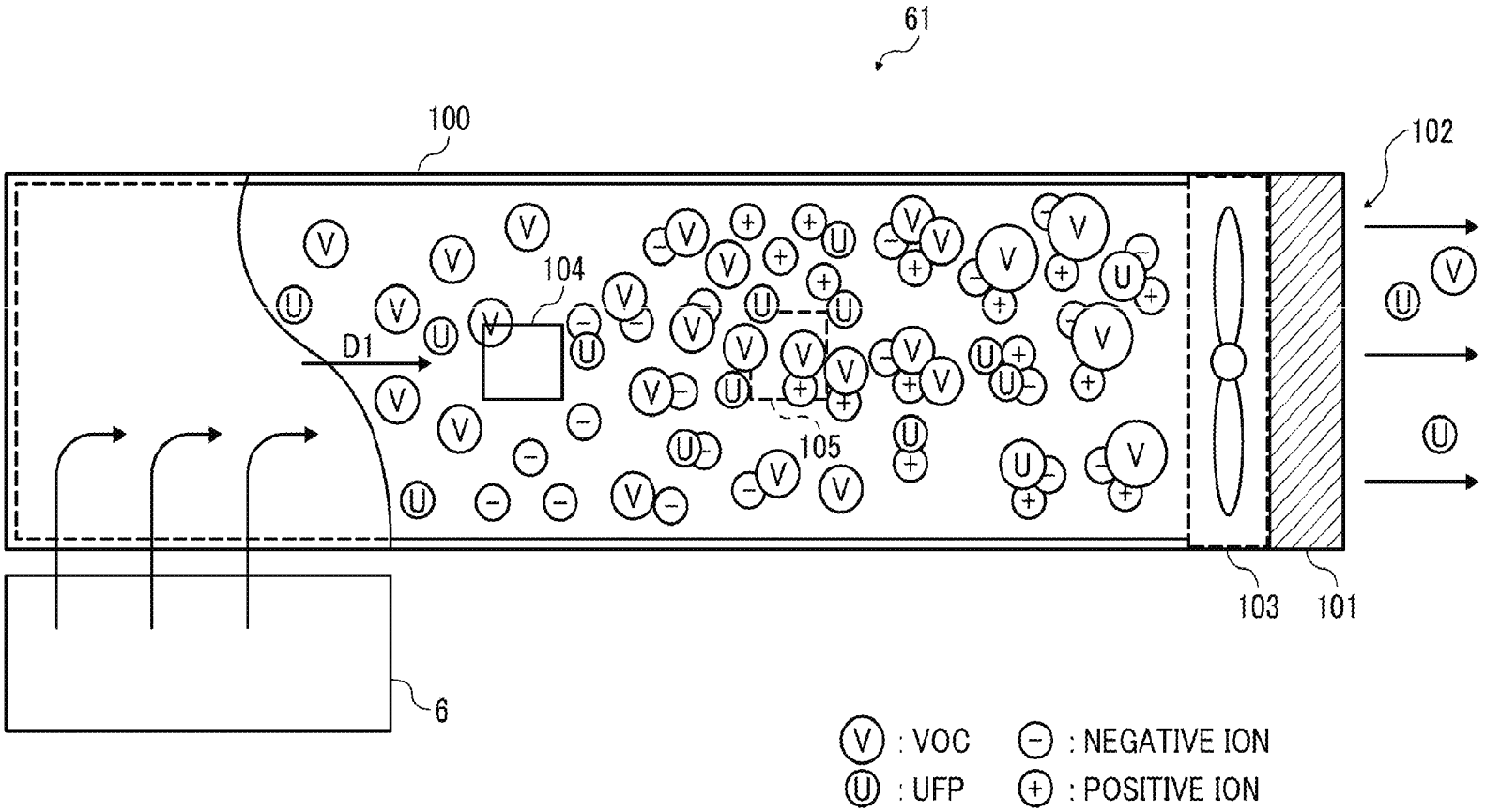
FIG. 4B is a side view of the exhauster depicted in FIG. 4A.

FIGS. 4A and 4B illustrate a diagram of the exhauster 61 according to the first embodiment. FIG. 4A is a plan view of the exhauster 61. FIG. 4B is a side view of the exhauster 61.

As illustrated in FIG. 3, the exhaust duct 100 serving as an exhaust path is disposed above the fixing device 6. As illustrated in FIGS. 4A and 4B, a filter 101 is disposed at a most downstream part of the exhaust duct 100 in an air flow direction D1 of air moving inside the exhaust duct 100. The filter 101 collects a VOC 203 and a UFP 204 that are aggregated. A fan 103 is disposed upstream from the filter 101 in the air flow direction D1. The fan 103 creates a current of air, which guides air inside the image forming apparatus 1 to an outlet 102. Alternatively, the filter 101 may be disposed upstream from the fan 103 in the air flow direction D1.

A negative ion generator 104 is disposed upstream from the filter 101 and the fan 103 in the air flow direction D1. The negative ion generator 104 emits a negative ion through a part of a wall 81 of the exhaust duct 100. A positive ion generator 105 is disposed on a wall 82 of the exhaust duct 100, which is disposed opposite the wall 81 on which the negative ion generator 104 is disposed. The positive ion generator 105 is disposed downstream from the negative ion generator 104 in the air flow direction D1 due to reasons below.

If the negative ion generator 104 is disposed opposite the positive ion generator 105 and aligned in a direction perpendicular to the air flow direction D1, a negative ion generated by the negative ion generator 104 and a positive ion generated by the positive ion generator 105 may be directed to an identical position inside the exhaust duct 100 and may be susceptible to collision with each other. Accordingly the negative ion and the positive ion may attract each other and may neutralize, decreasing the number of the negative ions and the positive ions and degrading efficiency in ionization of the UFPs.

An optimal offset amount of the negative ion and the positive ion varies depending on an airflow velocity and an aperture shape of the exhaust duct 100 in cross-section. If the exhaust duct 100 is wide enough in the direction perpendicular to the air flow direction D1, even if the negative ion generator 104 is disposed opposite the positive ion generator 105, the negative ion generator 104 and the positive ion generator 105 achieve advantages. At least one of the negative ion generator 104 and the positive ion generator 105 may be constructed of a plurality of ion generators. The number of the ion generators of the negative ion generator 104 may be different from the number of the ion generators of the positive ion generator 105. Accordingly, the number of negative ions and positive ions increases, enhancing efficiency in ionization of ultra fine particles. The MHMS305-01 type ionizer for generating negative ions that is available from Murata Manufacturing Co., Ltd. is used as the negative ion generator 104. The MHMS400-01 type ionizer for generating positive ions that is available from Murata Manufacturing Co., Ltd. is used as the positive ion generator 105. Those ion generators, which are installed in home electronics used in a house and a vehicle such as an air cleaner, an air conditioner, and a humidifier, are compact and useful. Alternatively, ion generators of other types may be employed.

The negative ion generator 104 and the positive ion generator 105 are mounted on the exhaust duct 100 such that a negative ion inlet 104*a* of the exhaust duct 100 through which a negative ion generated by the negative ion generator 104 enters the exhaust duct 100 is shifted from a positive ion inlet 105*a* of the exhaust duct 100 through which a positive ion generated by the positive ion generator 105 enters the exhaust duct 100. Accordingly, the negative ion adheres to a VOC and a UFP that flow into the exhaust duct 100 from an inside of the image forming apparatus 1. Since the positive ion generated by the positive ion generator 105 is not directed to the negative ion inlet 104*a* of the exhaust duct 100 through which the negative ion generated by the negative ion generator 104 enters the exhaust duct 100, the negative ion is not bonded to the positive ion. Since negative ions in a sufficient number float, the negative ions readily adhere even to the UFPs that are smaller in the particle diameter and the number than the VOCs. Thereafter, air moves in the air flow direction D1. Positive ions generated by the positive ion generator 105 adhere to the VOCs and the UFPs not adhered with negative ions at the positive ion inlet 105*a* of the exhaust duct 100.

The VOC charged negatively and the VOC charged positively are bonded by the Coulomb force into a VOC 201 and aggregated into a VOC 203. The UFP charged negatively and the UFP charged positively are bonded by the Coulomb force into a UFP 202 and aggregated into a UFP 204. Accordingly, the number of the VOCs and the UFPs decreases compared to the number of the VOCs and the UFPs contained in air at a most upstream portion of the exhaust duct 100 in the air flow direction D1. Hence, the number of the UFPs defined by the BAM standard decreases. Additionally, a VOC is bonded to another VOC into a bonded VOC or a UFP is bonded to another UFP into a bonded UFP, increasing the particle diameter of the bonded VOC and the bonded UFP. Accordingly, the filter 101 collects the VOCs and the UFPs effectively, decreasing the number of the VOCs and the UFPs emitted through the outlet 102 to an outside of the image forming apparatus 1.

Further, the number of the VOCs and the UFPs that precipitate and adhere to an interior wall and the like of the exhaust duct 100 increases, decreasing the amount of the VOCs and the UFPs that are emitted to the outside of the image forming apparatus 1 in addition to the number of the VOCs and the UFPs that are emitted to the outside of the image forming apparatus 1.

A description is provided of a construction of an exhauster 62 according to a second embodiment.

Figure 5A:
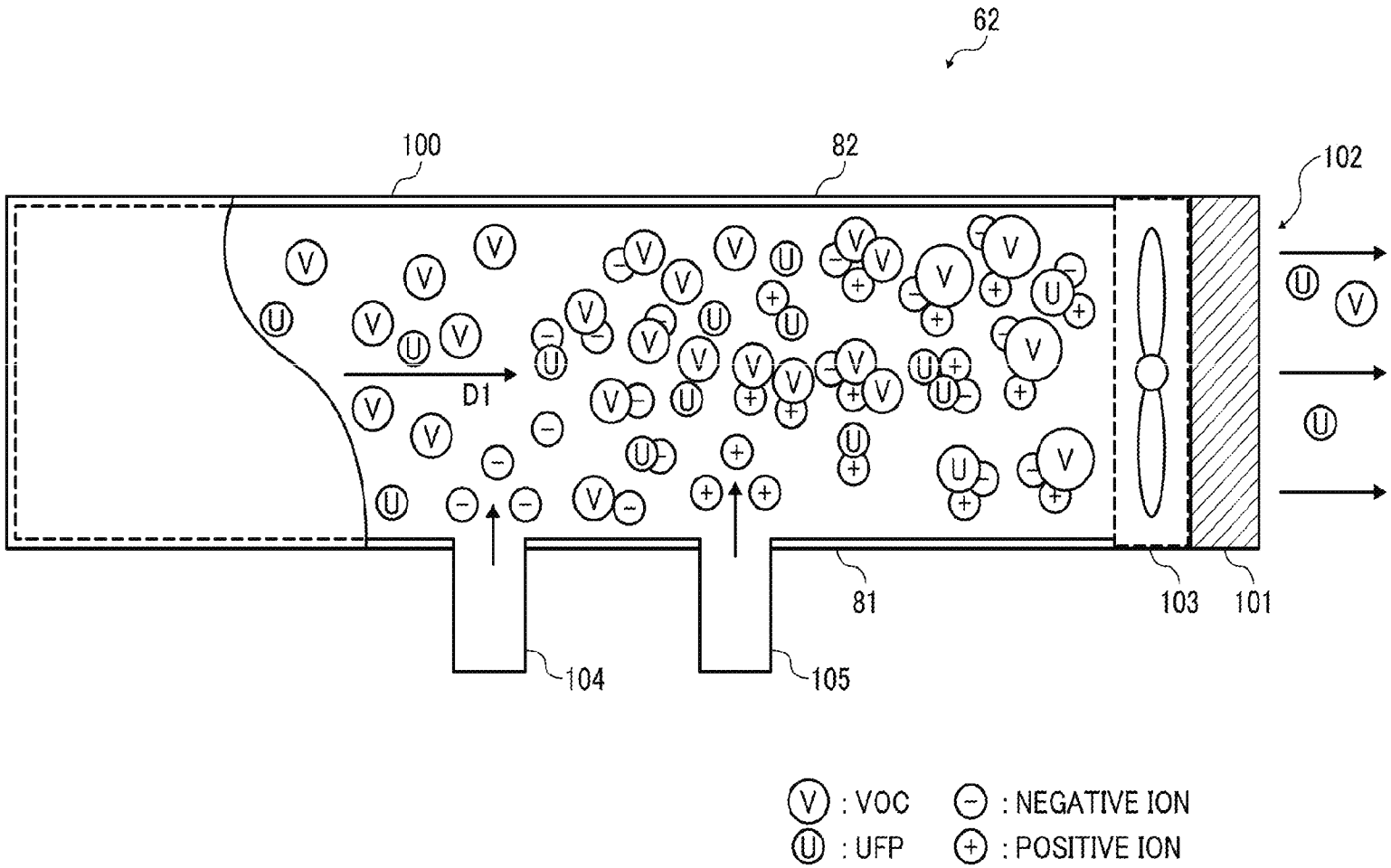
FIG. 5A is a plan view of an exhauster according to a second embodiment, which is incorporated in the image forming apparatus depicted in FIG. 1.
Figure 5B:
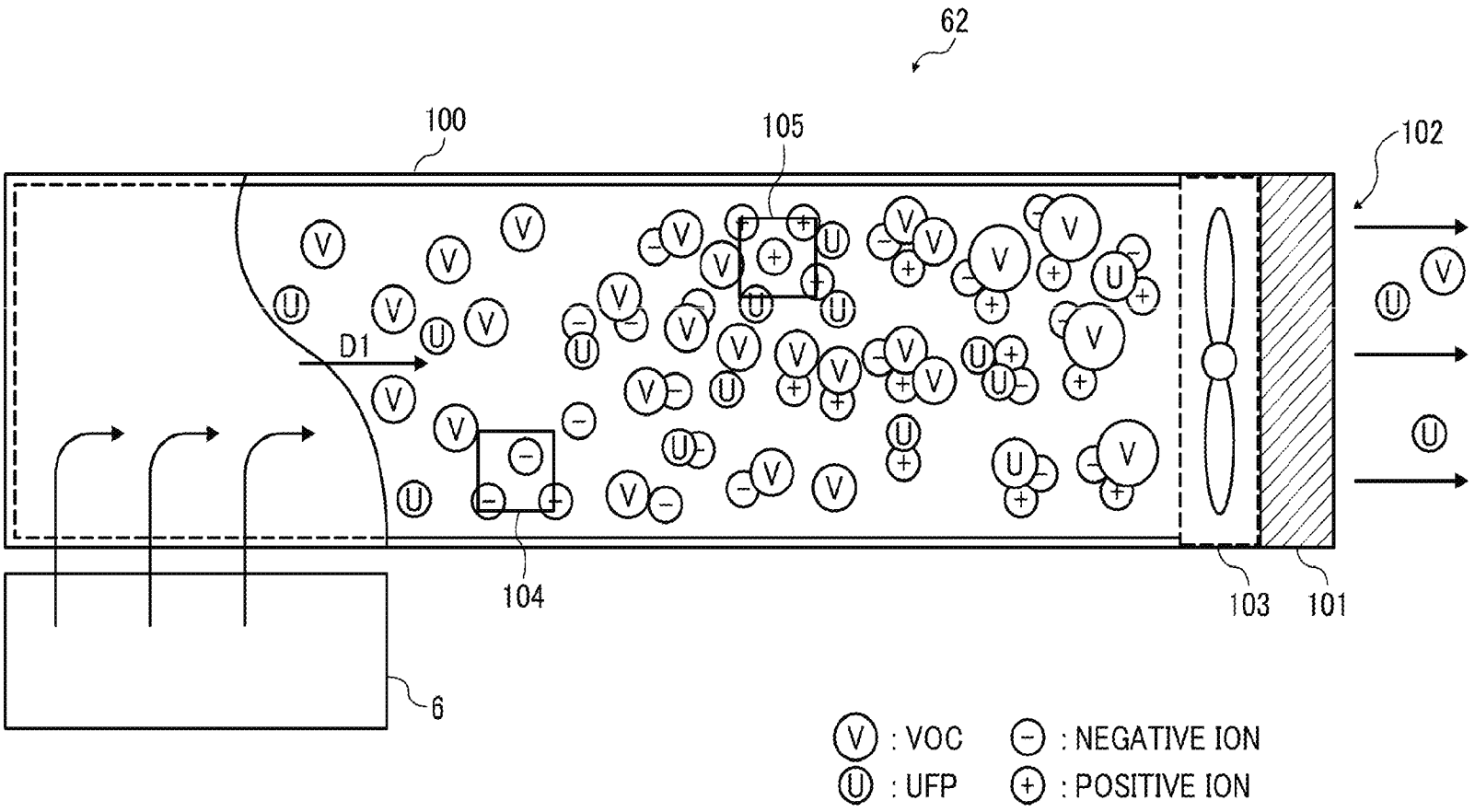
FIG. 5B is a side view of the exhauster depicted in FIG. 5A.

FIGS. 5A and 5B illustrate a diagram of the exhauster 62 according to the second embodiment. FIG. 5A is a plan view of the exhauster 62. FIG. SB is a side view of the exhauster 62.

As illustrated in FIGS. 5A and 5B, the exhauster 62 includes the negative ion generator 104 and the positive ion generator 105 that are mounted on an identical wall, that is, the wall 81 of the exhaust duct 100. Accordingly, a negative ion emitted from the negative ion generator 104 and a positive ion emitted from the positive ion generator 105 are directed in an identical direction. Consequently, the negative ion and the positive ion do not collide and attract each other easily, suppressing neutralization, decrease in the number of the negative ions and the positive ions, and degradation in efficiency in ionization of the VOCs and the UFPs. As illustrated in FIG. 5B, the negative ion generator 104 is shifted from the positive ion generator 105 vertically in FIG. SB in the direction perpendicular to the air flow direction D1, thus enhancing efficiency in ionization of the VOCs and the UFPs.

A description is provided of a construction of an exhauster 63 according to a third embodiment.

Figure 6A:
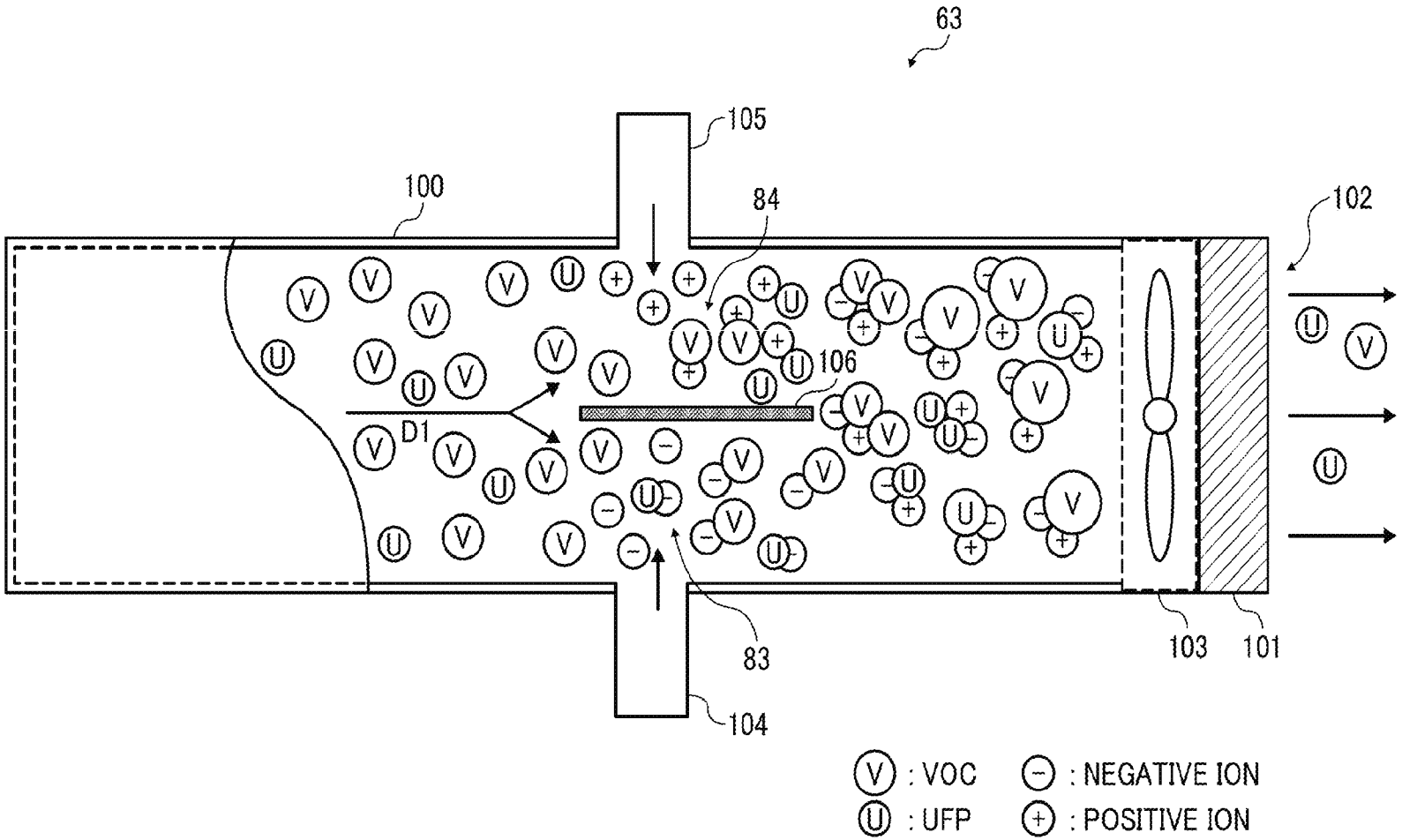
FIG. 6A is a plan view of an exhauster according to a third embodiment, which is incorporated in the image forming apparatus depicted in FIG. 1.
Figure 6B:
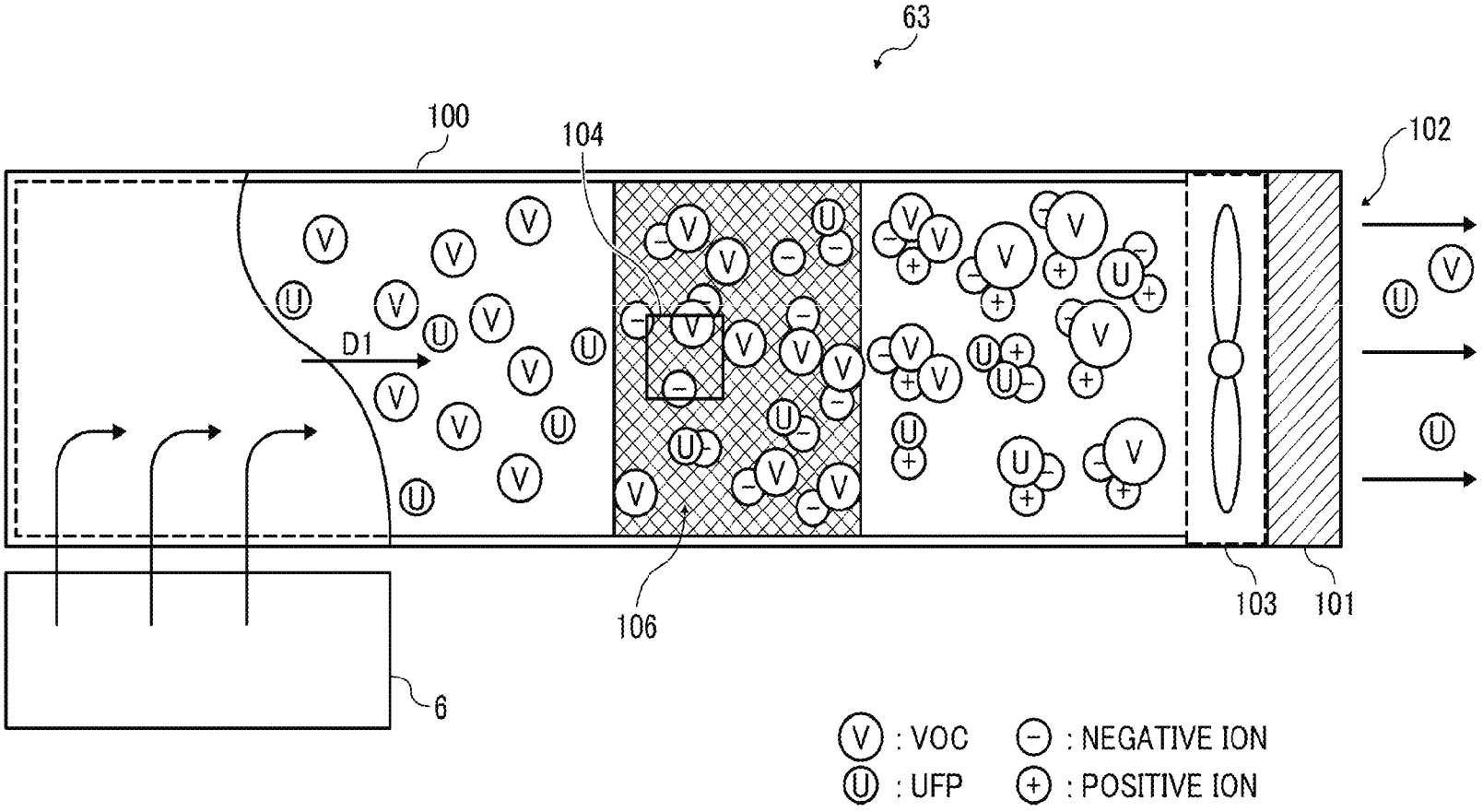
FIG. 6B is a side view of the exhauster depicted in FIG. 6A.

FIGS. 6A and 6B illustrate a diagram of the exhauster 63 according to the third embodiment. FIG. 6A is a plan view of the exhauster 63. FIG. 6B is a side view of the exhauster 63.

As illustrated in FIGS. 6A and 6B, the negative ion generator 104 is disposed opposite the positive ion generator 105 in the direction perpendicular to the air flow direction D1. The exhauster 63 includes a partition 106 to prevent the negative ion generator 104 and the positive ion generator 105 from interfering each other. The partition 106 is disposed inside the exhaust duct 100. The partition 106 extends in the air flow direction D1 and vertically in FIG. 6B in the direction perpendicular to the air flow direction D1. As illustrated in FIG. 6A, the partition 106 divides an air passage inside the exhaust duct 100 into two sections, that is, a negative ion passage 83 and a positive ion passage 84, when seen in the air flow direction D1. The negative ion generator 104 emits a negative ion into the negative ion passage 83 of the exhaust duct 100. The positive ion generator 105 emits a positive ion into the positive ion passage 84 of the exhaust duct 100. The partition 106 prohibits the negative ion from moving into the positive ion passage 84 and prohibits the positive ion from moving into the negative ion passage 83. Accordingly, the negative ion and the positive ion do not collide each other easily and do adhere to the VOC and UFP separately. When the negative ion and the positive ion pass the partition 106, the VOC charged negatively and the VOC charged positively are bonded to each other by the Coulomb force and aggregated. The UFP charged negatively and the UFP charged positively are bonded to each other by the Coulomb force and aggregated.

According to the third embodiment, the number of the VOCs and the UFPs decreases compared to the number of the VOCs and the UFPs contained in air at the most upstream portion of the exhaust duct 100 in the air flow direction D1. Hence, the number of the UFPs defined by the BAM standard decreases. Additionally, a VOC is bonded to another VOC into a bonded VOC or a UFP is bonded to another UFP into a bonded UFP, increasing the particle diameter of the bonded VOC and the bonded UFP. Accordingly, the filter 101 collects the VOCs and the UFPs effectively, decreasing the number of the VOCs and the UFPs emitted through the outlet 102 to the outside of the image forming apparatus 1. Further, the number of the VOCs and the UFPs that precipitate and adhere to the interior wall and the like of the exhaust duct 100 increases, decreasing the amount of the VOCs and the UFPs that are emitted to the outside of the image forming apparatus 1 in addition to the number of the VOCs and the UFPs that are emitted to the outside of the image forming apparatus 1.

A description is provided of a construction of an exhauster 64 according to a fourth embodiment.

Figure 7A:
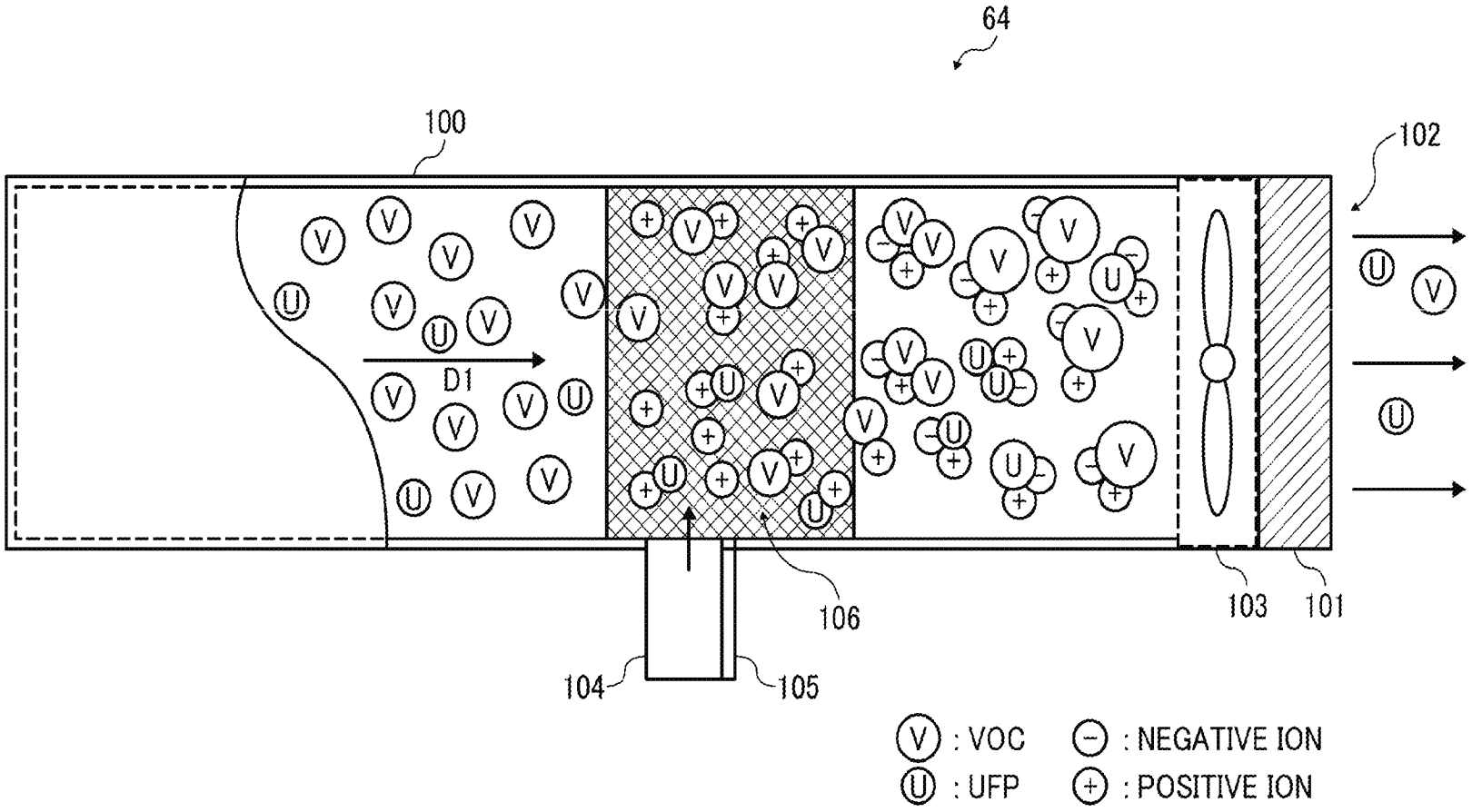
FIG. 7A is a plan view of an exhauster according to a fourth embodiment, which is incorporated in the image forming apparatus depicted in FIG. 1.
Figure 7B:
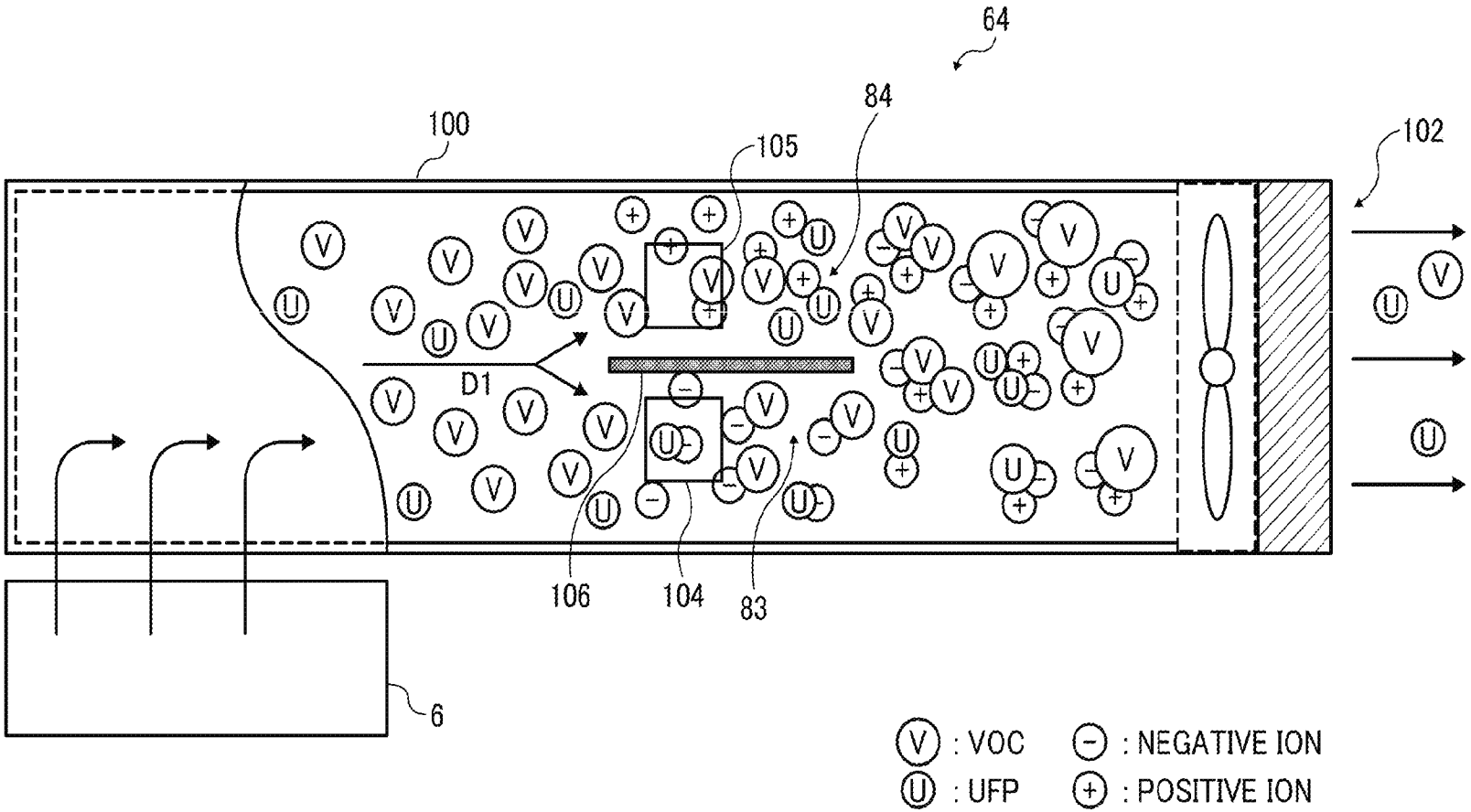
FIG. 7B is a side view of the exhauster depicted in FIG. 7A.

FIGS. 7A and 7B illustrate a diagram of the exhauster 64 according to the fourth embodiment. FIG. 7A is a plan view of the exhauster 64. FIG. 7B is a side view of the exhauster 64.

As illustrated in FIGS. 7A and 7B, unlike the partition 106 according to the third embodiment depicted in FIGS. 6A and 6B, the partition 106 according to the fourth embodiment disposed inside the exhaust duct 100 extends differently. The partition 106 extends horizontally in FIG. 7B in the air flow direction D1 and vertically in FIG. 7A in the direction perpendicular to the air flow direction D1. As illustrated in FIG. 7B, the partition 106 divides the air passage inside the exhaust duct 100 into two sections vertically, that is, the negative ion passage 83 and the positive ion passage 84, when seen in the air flow direction D1. The negative ion generator 104 emits a negative ion into the negative ion passage 83 of the exhaust duct 100, which is disposed below the positive ion passage 84 vertically. The positive ion generator 105 emits a positive ion into the positive ion passage 84 of the exhaust duct 100, which is disposed above the negative ion passage 83. The partition 106 prohibits the negative ion from moving into the positive ion passage 84 and prohibits the positive ion from moving into the negative ion passage 83. Accordingly, the negative ion and the positive ion do not collide each other easily and do adhere to the VOC and UFP separately. When the negative ion and the positive ion pass the partition 106, the VOC charged negatively and the VOC charged positively are bonded to each other by the Coulomb force and aggregated. The UFP charged negatively and the UFP charged positively are bonded to each other by the Coulomb force and aggregated.

The partition 106 according to the fourth embodiment suppresses bonding of the negative ion and the positive ion, facilitates adhesion of the negative ion or the positive ion to the VOC and the UFP, and improves charging of the VOC and the UFP. Accordingly, the partition 106 facilitates aggregation of the VOCs and the UFPs, decreasing the number of the VOCs and the UFPs emitted through the outlet 102 to the outside of the image forming apparatus 1.

A description is provided of a construction of an exhauster 65 according to a fifth embodiment.

Figure 8A:
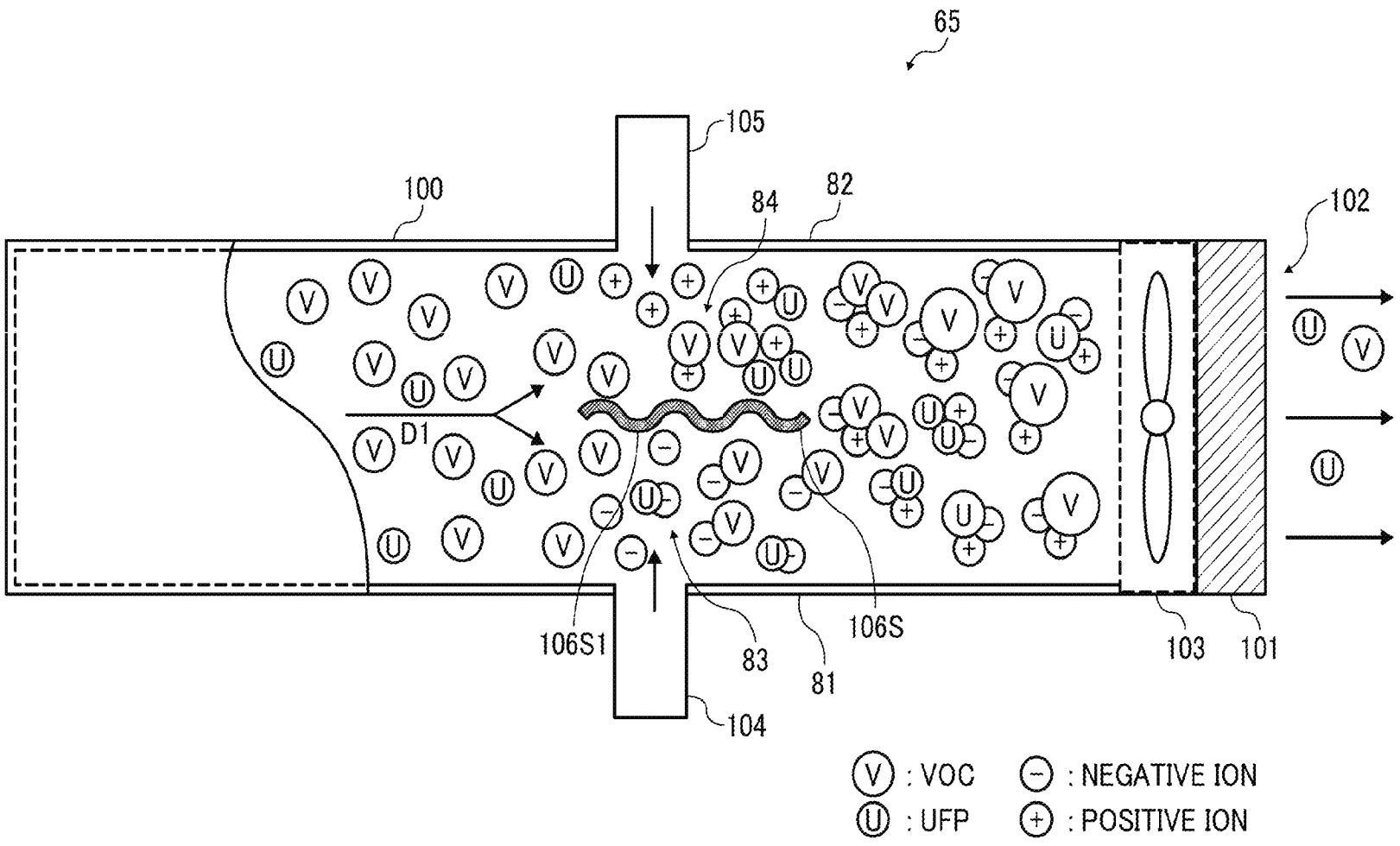
FIG. 8A is a plan view of an exhauster according to a fifth embodiment, which is incorporated in the image forming apparatus depicted in FIG. 1.
Figure 8B:
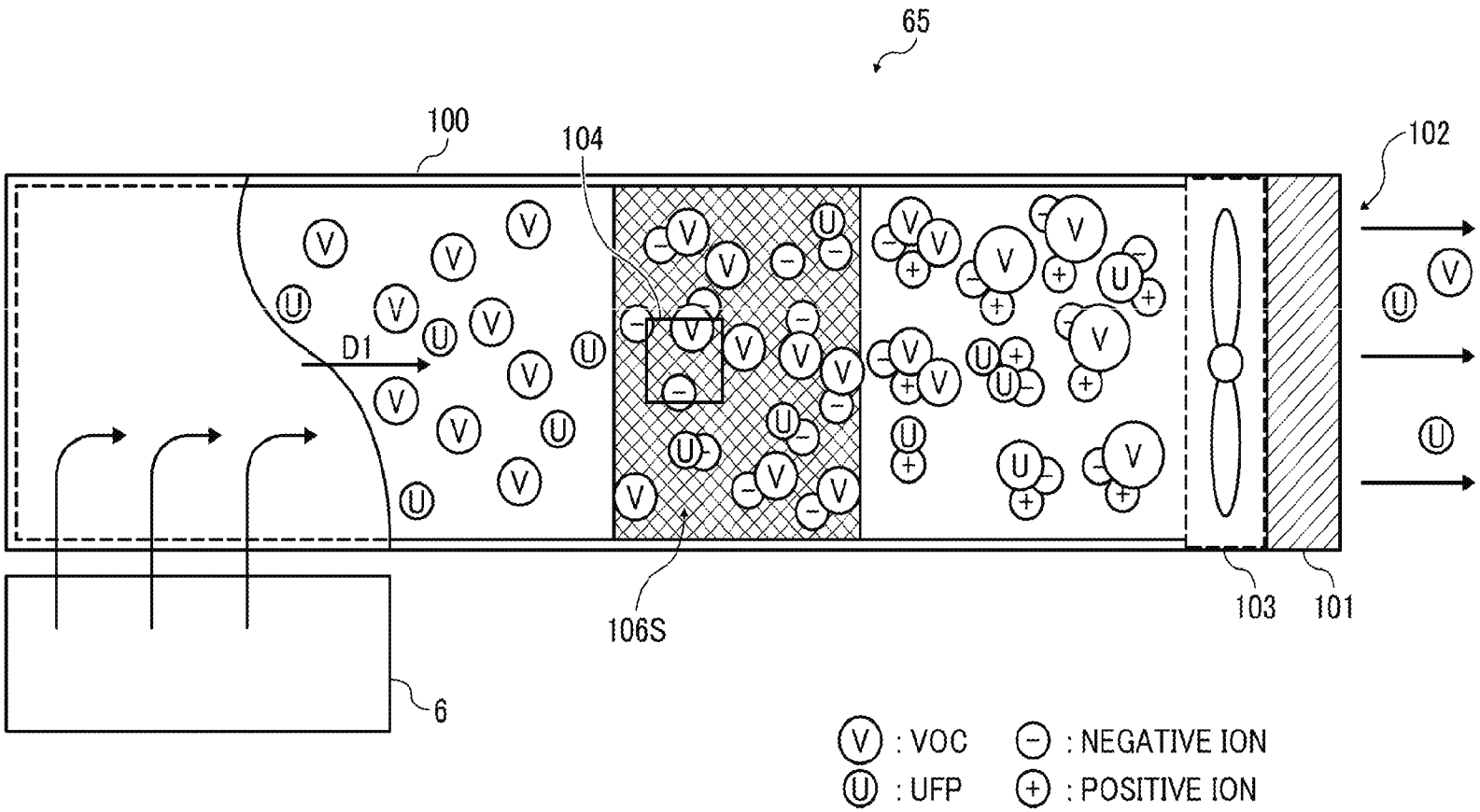
FIG. 8B is a side view of the exhauster depicted in FIG. 8A.

FIGS. 8A and 8B illustrate a diagram of the exhauster 65 according to the fifth embodiment. FIG. 8A is a plan view of the exhauster 65. FIG. 8B is a side view of the exhauster 65.

As illustrated in FIGS. 8A and 8B, unlike the partition 106 according to the third embodiment depicted in FIGS. 6A and 6B, a partition 106S according to the fifth embodiment is not straight in cross-section. The partition 106S is wavy or uneven in cross-section. For example, the partition 106S includes a wave or a projection and a recess. As illustrated in FIG. 8A, the partition 106S divides the air passage inside the exhaust duct 100 into two sections vertically, that is, the negative ion passage 83 and the positive ion passage 84, when seen in the air flow direction D1. The partition 106S agitates air moving through the exhaust duct 100. Alternatively, the walls 81 and 82 of the exhaust duct 100 may not be straight also.

The partition 106S according to the fifth embodiment enhances efficiency in adhesion of the negative ion or the positive ion to the VOC and the UFP and improves charging of the VOC and the UFP. Accordingly, the partition 106S facilitates aggregation of the VOCs and the UFPs, decreasing the number of the VOCs and the UFPs emitted through the outlet 102 to the outside of the image forming apparatus 1.

A description is provided of a construction of an exhauster 66 according to a sixth embodiment.

Figure 9A:
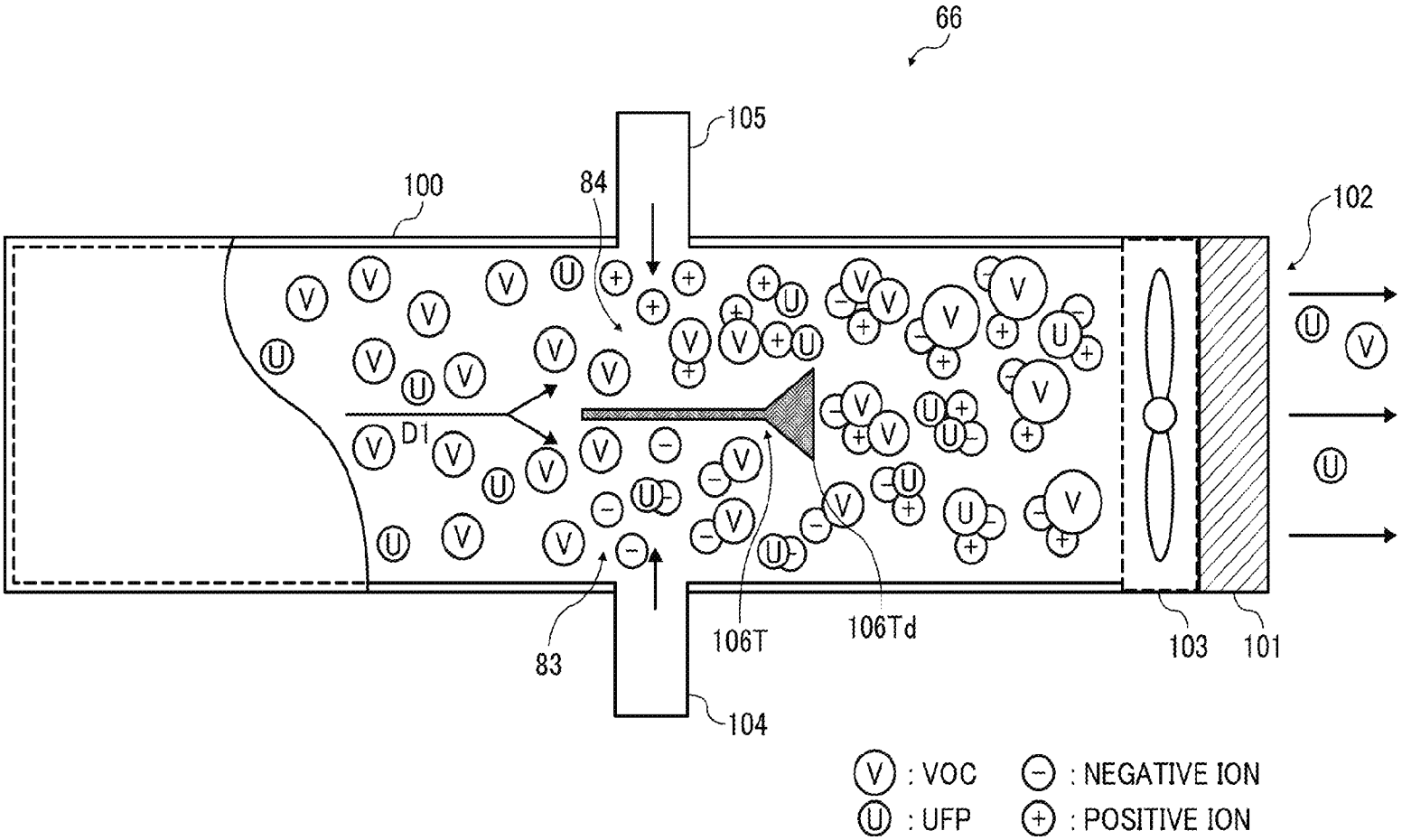
FIG. 9A is a plan view of an exhauster according to a sixth embodiment, which is incorporated in the image forming apparatus depicted in FIG. 1.
Figure 9B:
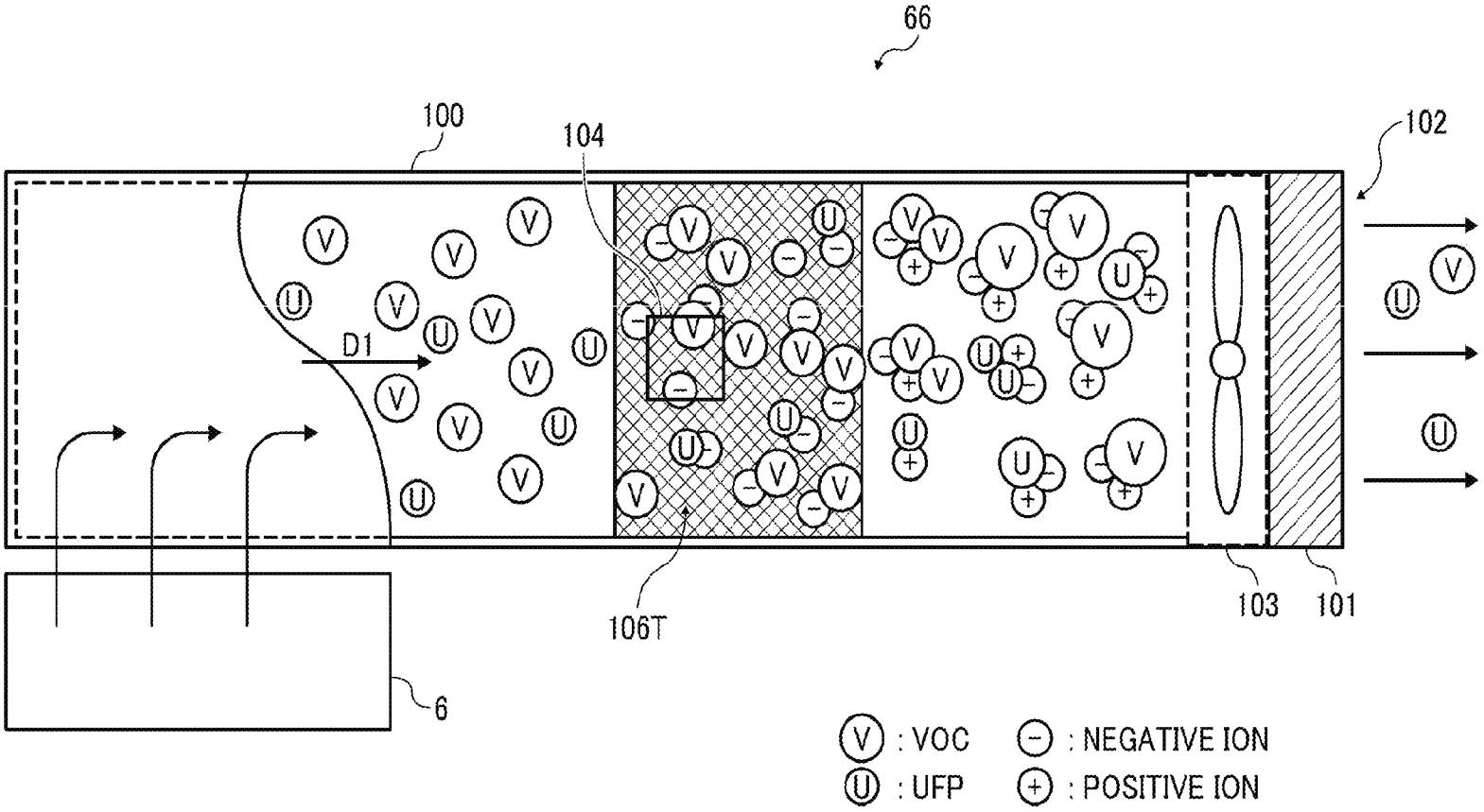
FIG. 9B is a side view of the exhauster depicted in FIG. 9A.
Figure 10A:
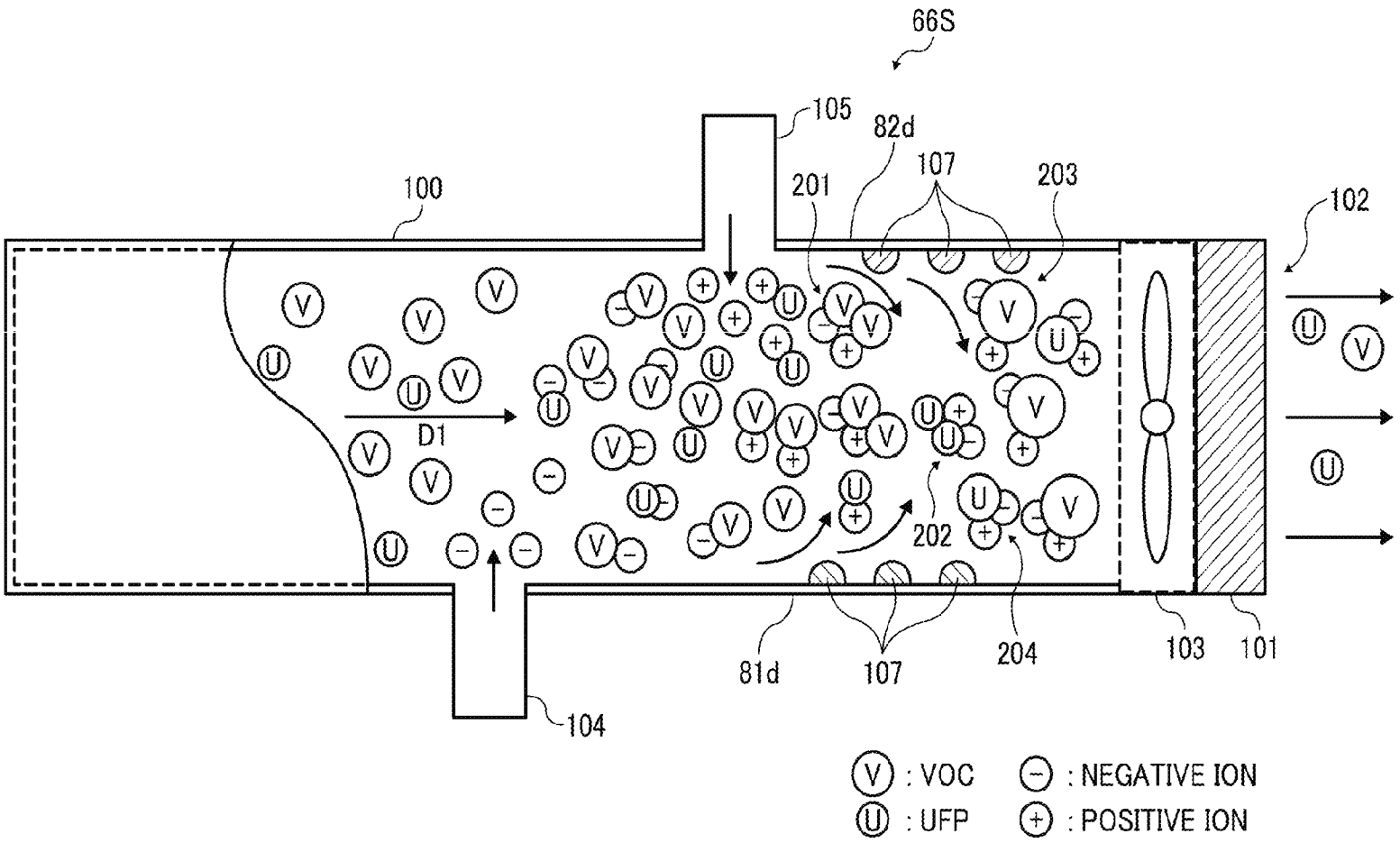
FIG. 10A is a plan view of an exhauster according to a variation of the sixth embodiment, which is incorporated in the image forming apparatus depicted in FIG. 1.
Figure 10B:
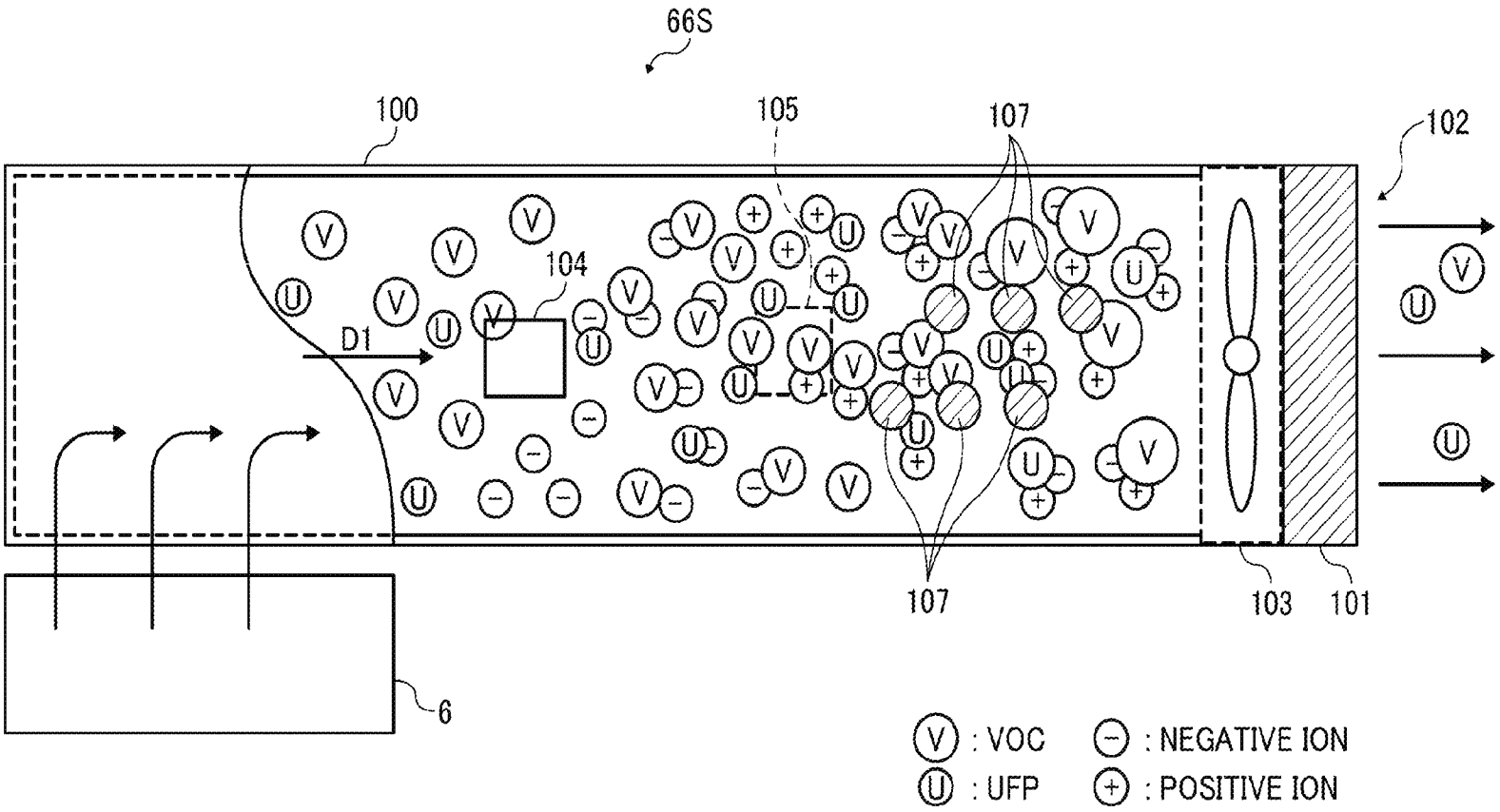
FIG. 10B is a side view of the exhauster depicted in FIG. 10A.

FIGS. 9A and 9B illustrate a diagram of the exhauster 66 according to the sixth embodiment. FIG. 9A is a plan view of the exhauster 66. FIG. 9B is a side view of the exhauster 66. FIGS. 10A and 10B illustrate a diagram of an exhauster 66S according to a variation of the sixth embodiment. FIG. 10A is a plan view of the exhauster 66S. FIG. 10B is a side view of the exhauster 66S.

As illustrated in FIGS. 9A and 9B, unlike the partition 106 according to the third embodiment depicted in FIGS. 6A and 6B, the exhauster 66 according to the sixth embodiment includes a partition 106T including a downstream portion 106Td in the air flow direction D1. The downstream portion 106Td is triangular in cross-section when seen from above. As illustrated in FIG. 9A, the partition 106T divides the air passage inside the exhaust duct 100 into two sections vertically, that is, the negative ion passage 83 and the positive ion passage 84, when seen in the air flow direction D1. The partition 106T swirls air moving through the exhaust duct 100 substantially before passing the partition 106T, agitating the air in the air passage inside the exhaust duct 100.

As illustrated in FIGS. 10A and 10B, the exhauster 66S includes the exhaust duct 100 having downstream walls 81*d* and 82*d* that are not straight, facilitating agitation of air and enhancing efficiency in ionization. FIGS. 10A and 10B illustrate one example of the downstream walls 81*d* and 82*d* that are not straight. Each of the downstream walls 81*d* and 82*d* includes a plurality of projections 107. Alternatively, the downstream walls 81*d* and 82*d* may have other shapes that agitate air.

The partition 106T according to the sixth embodiment and the projections 107 according to the variation of the sixth embodiment enhance efficiency in adhesion of the negative ion or the positive ion to the VOC and the UFP and improve charging of the VOC and the UFP. Accordingly, the partition 106T and the projections 107 facilitate aggregation of the VOCs and the UFPs, decreasing the number of the VOCs and the UFPs emitted through the outlet 102 to the outside of the image forming apparatus 1.

An amount of the UFPs generated by an image forming apparatus varies depending on a condition under which the image forming apparatus is used and a material of parts of the image forming apparatus. Accordingly, if the image forming apparatus generates a substantial amount of the UFPs, it is necessary to further decrease an amount of the UFPs emitted to an outside of the image forming apparatus. In this case, the exhausters 61 to 66 and 66S may suffer from limitation of enhancement in efficiency in collecting the UFPs generated in the substantial amount.

A description is provided of a construction of a first comparative image forming apparatus.

The first comparative image forming apparatus has a configuration in which a negative ion or a positive ion is adhered to a volatile organic compound charged negatively or positively and the volatile organic compound is neutralized.

However, the first comparative image forming apparatus may not decrease an amount of ultra fine particles emitted to an outside of the first comparative image forming apparatus sufficiently. The ultra fine particle generates inside the first comparative image forming apparatus and has a particle diameter smaller than that of the volatile organic compound.

A description is provided of a construction of a second comparative image forming apparatus.

The second comparative image forming apparatus includes an exhaust duct that exhausts air and is divided into two passages provided with chargers having opposite polarities to charge air moving through the two passages, respectively. After the charged air is gathered and aggregated, a filter charged negatively or positively collects the air.

A description is provided of a construction of a third comparative image forming apparatus.

The third comparative image forming apparatus includes an exhaust duct provided with a charger and a collector that are charged with opposite polarities, respectively. The charger and the collector are connected in series in an air exhaust direction.

However, the second comparative image forming apparatus has the exhaust duct that is branched to produce the two passages, resulting in a complex structure. The third comparative image forming apparatus has the collector including a filter that is perpendicular to the air exhaust direction, degrading efficiency in exhaust of air. To address this circumstance, a large capacity fan is needed. The first comparative image forming apparatus, the second comparative image forming apparatus, and the third comparative image forming apparatus charge ultra fine particles each of which has a diameter in a range of from 5 nm to 550 nm as a target, aggregate the ultra fine particles, and collect the ultra fine particles with the filter. However, since all the ultra fine particles are not aggregated, some of the ultra fine particles, although being charged, may remain being not aggregated while having a small particle diameter. The ultra fine particles having the small particle diameter may slip through the filter and may be emitted to an outside of the first comparative image forming apparatus, the second comparative image forming apparatus, and the third comparative image forming apparatus, thus hindering improvement in efficiency in collecting the ultra fine particles by the filter. To address this circumstance, the image forming apparatus 1 has an exhauster according to embodiments described below.

A description is provided of a construction of an exhauster 67 according to a seventh embodiment.

Figure 11A:
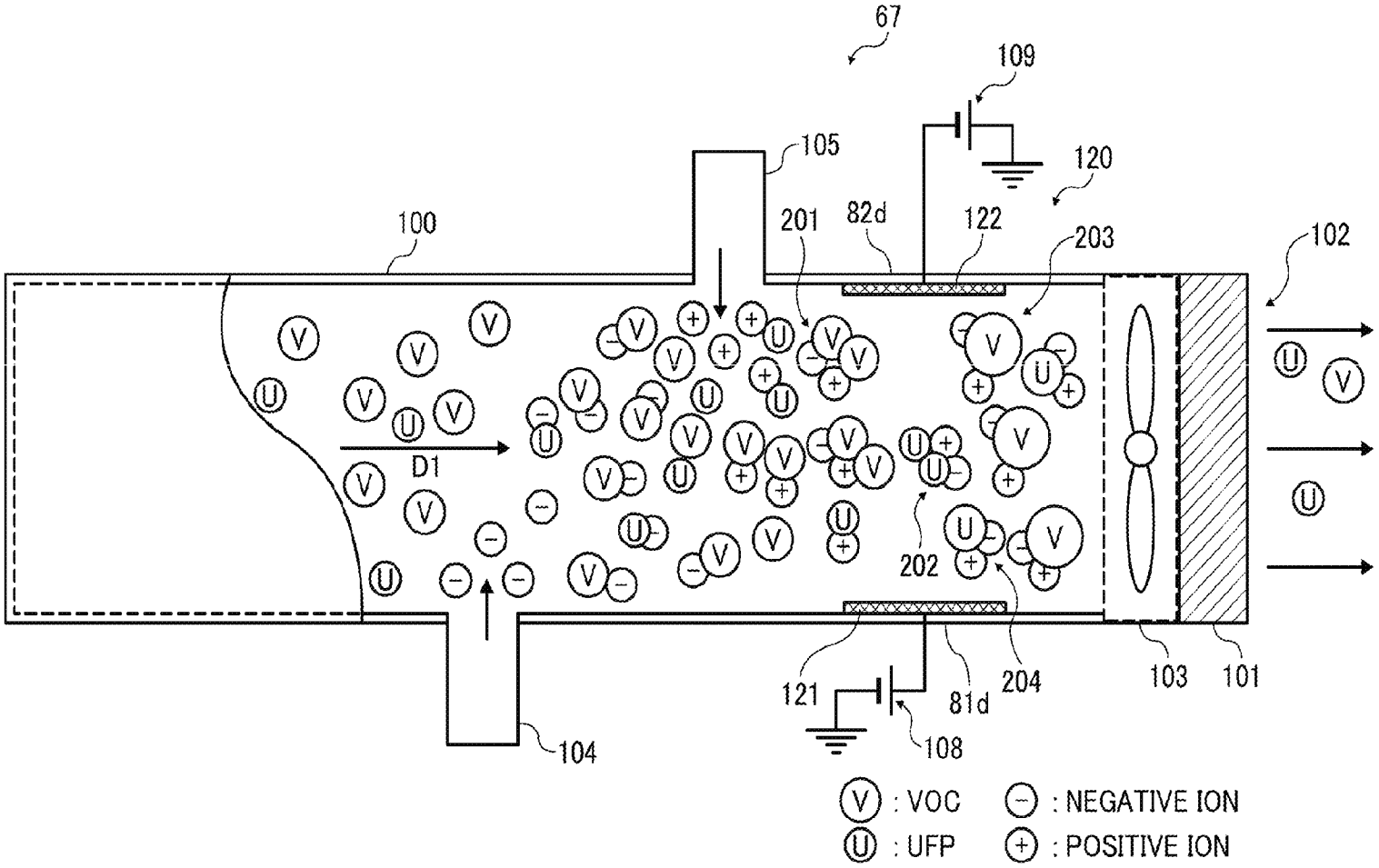
FIG. 11A is a plan view of an exhauster according to a seventh embodiment, which is incorporated in the image forming apparatus depicted in FIG. 1.
Figure 11B:
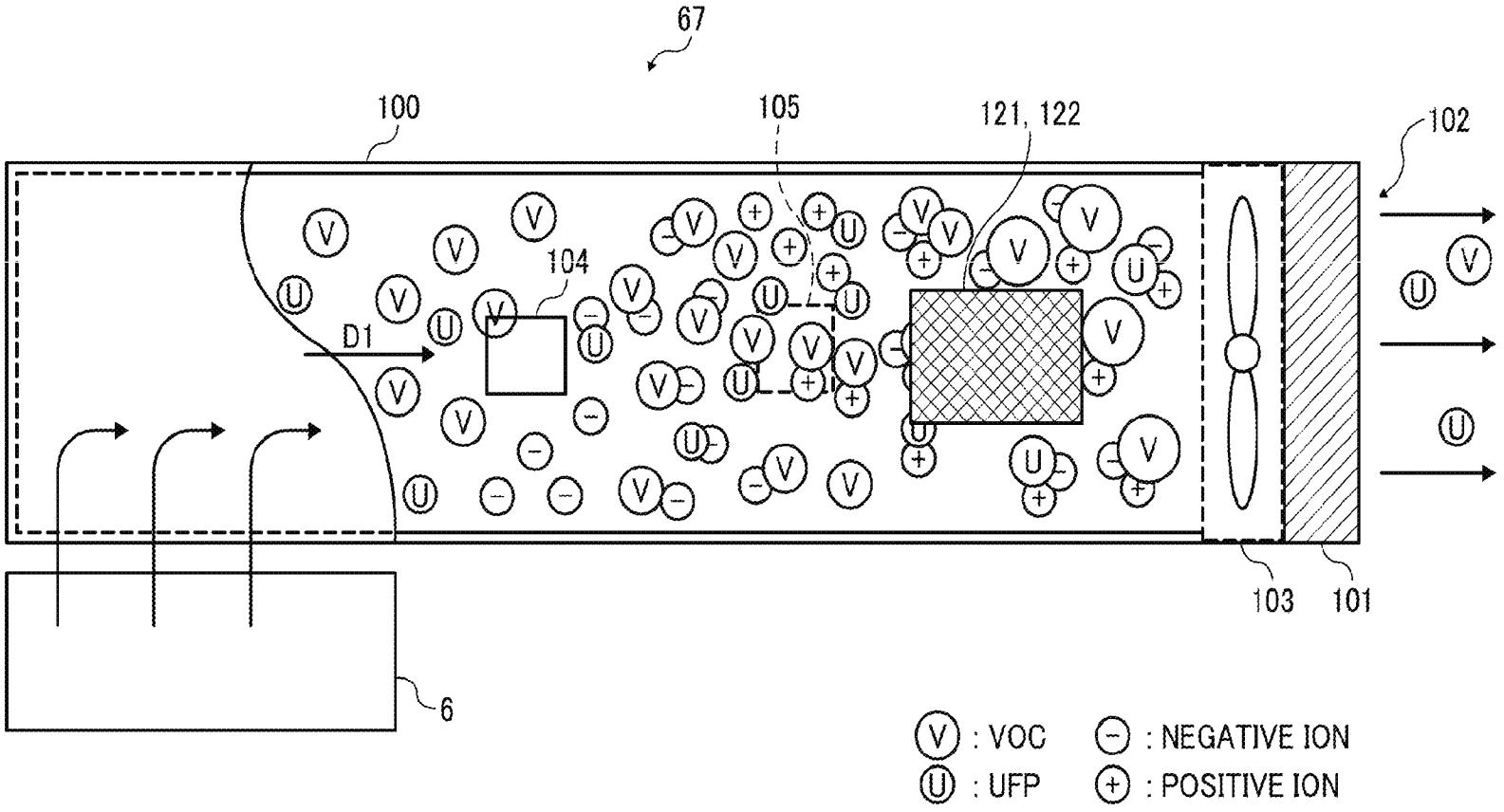
FIG. 11B is a side view of the exhauster depicted in FIG. 11A.

FIGS. 11A and 11B illustrate a diagram of the exhauster 67 according to the seventh embodiment. FIG. 11A is a plan view of the exhauster 67. FIG. 11B is a side view of the exhauster 67.

As illustrated in FIGS. 11A and 11B, in addition to the construction of the exhauster 61 according to the first embodiment depicted in FIGS. 4A and 4B, the exhauster 67 according to the seventh embodiment includes a counter electrode pair 120 disposed downstream from the negative ion generator 104 and the positive ion generator 105 in the air flow direction D1. The counter electrode pair 120 includes a positive electrode 121 and a negative electrode 122 disposed opposite the positive electrode 121. A high voltage power supply 108 applies a positive direct current voltage to the positive electrode 121. A high voltage power supply 109 applies a negative direct current voltage to the negative electrode 122. Accordingly, a VOC and a UFP adhered with negative ions and charged negatively are electrostatically attracted to and collected by the positive electrode 121. A VOC and a UFP adhered with positive ions and charged positively are electrostatically attracted to and collected by the negative electrode 122. Each of the positive electrode 121 and the negative electrode 122 is made of metal or conductive resin. Each of the positive electrode 121 and the negative electrode 122 is removably fastened to the exhaust duct 100 with a fastener (e.g., a screw).

According to the seventh embodiment, the counter electrode pair 120, that is constructed of the positive electrode 121 and the negative electrode 122 mounted on the downstream walls 81*d* and 82*d* of the exhaust duct 100, respectively, electrostatically attracts and collects the VOCs and the UFPs not aggregated, decreasing the number of the VOCs and the UFPs emitted through the outlet 102 to the outside of the image forming apparatus 1. The positive electrode 121 mounted on the downstream wall 81*d* of the exhaust duct 100 and the negative electrode 122 mounted on the downstream wall 82*d* of the exhaust duct 100 are parallel to the air flow direction D1. Accordingly, the positive electrode 121 and the negative electrode 122 are positioned flexibly to adjust an effective area according to a length of the air passage without disturbing airflow. The positive electrode 121 and the negative electrode 122 collect fine particles not aggregated and barely collected by the filter 101 before the fine particles reach the filter 101. Accordingly, the positive electrode 121 and the negative electrode 122 reduce a load imposed on the filter 101 and decrease the number of the VOCs and the UFPs emitted through the outlet 102 to the outside of the image forming apparatus 1.

A description is provided of a construction of an exhauster 68 according to an eighth embodiment.

Figure 12A:
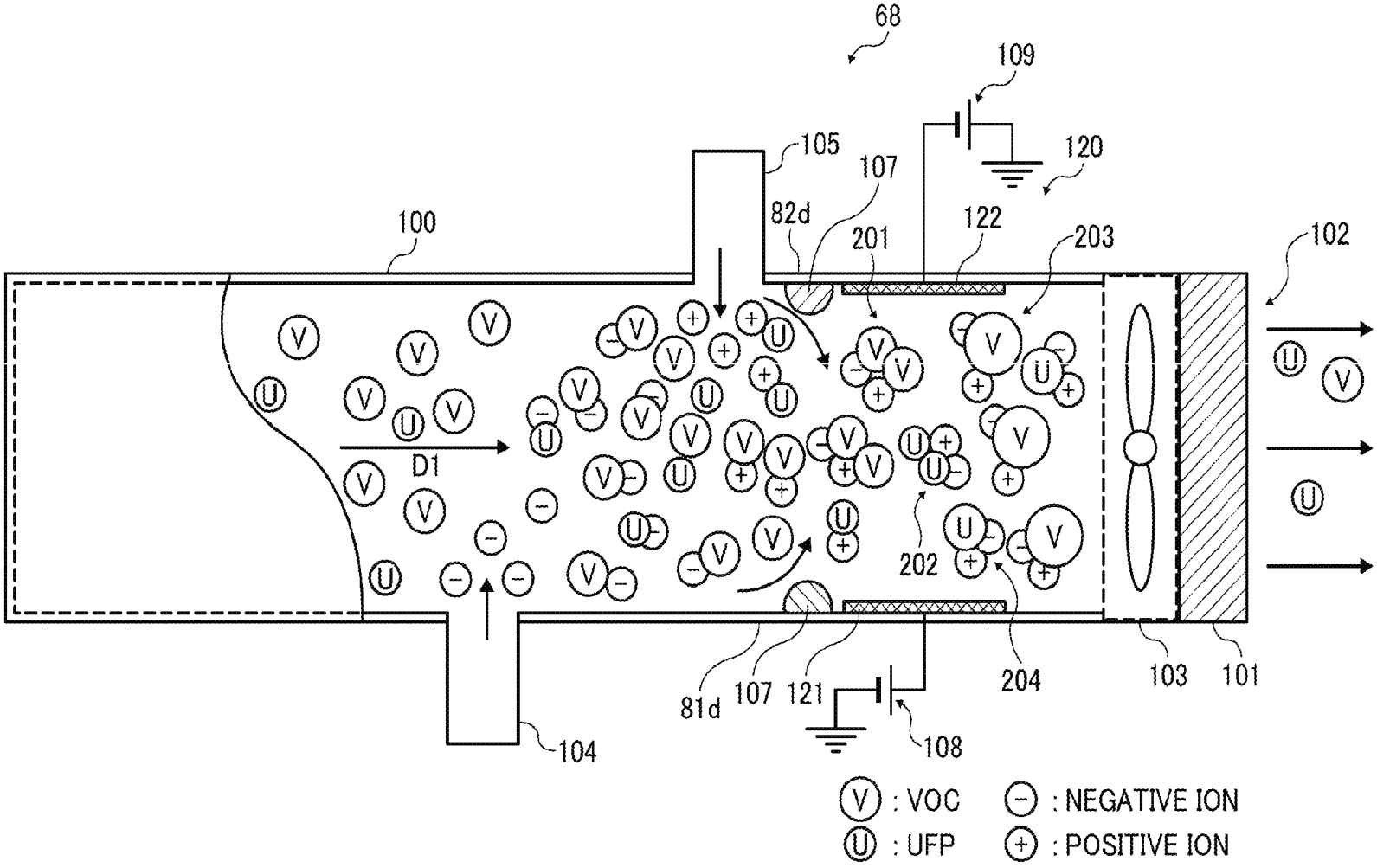
FIG. 12A is a plan view of an exhauster according to an eighth embodiment, which is incorporated in the image forming apparatus depicted in FIG. 1.
Figure 12B:
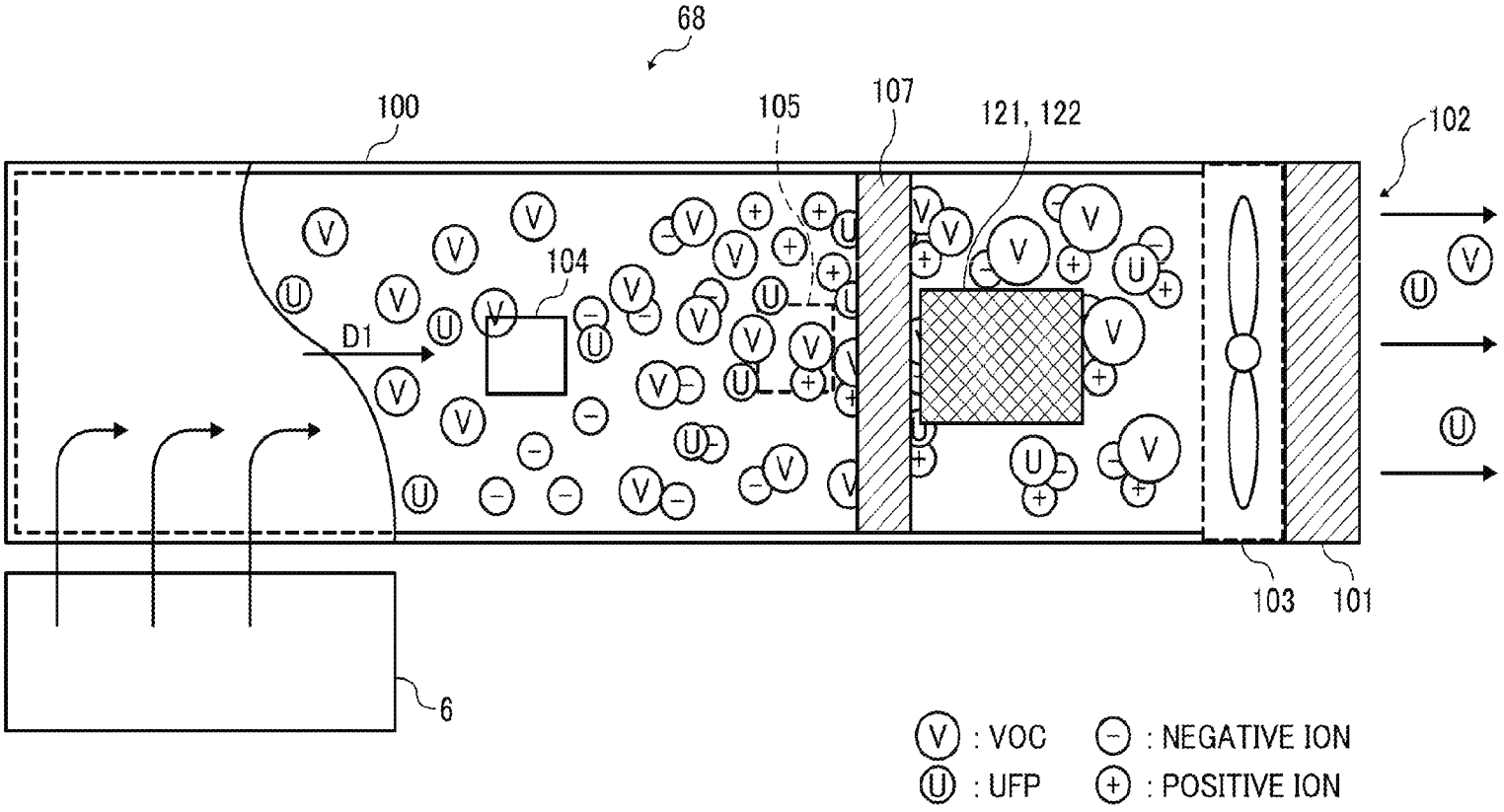
FIG. 12B is a side view of the exhauster depicted in FIG. 12A.

FIGS. 12A and 12B illustrate a diagram of the exhauster 68 according to the eighth embodiment. FIG. 12A is a plan view of the exhauster 68. FIG. 12B is a side view of the exhauster 68.

As illustrated in FIGS. 12A and 12B, in addition to the construction of the exhauster 67 according to the seventh embodiment depicted in FIGS. 11A and 11B, the exhauster 68 according to the eighth embodiment includes the downstream walls 81*d* and 82*d* that are not straight in cross-section and are disposed downstream from the negative ion generator 104 and the positive ion generator 105 in the air flow direction D1. For example, FIGS. 12A and 12B illustrate one example of the downstream walls 81*d* and 82*d* of the exhaust duct 100, which are not straight and mount the projections 107, respectively. The projections 107 are disposed upstream from the positive electrode 121 and the negative electrode 122, respectively, in the air flow direction D1. According to the eighth embodiment, compared to the seventh embodiment, the downstream walls 81*d* and 82*d* that are not straight agitate air inside the exhaust duct 100, enhancing efficiency in aggregation of the VOCs and the UFPs and decreasing the number of the VOCs and the UFPs emitted through the outlet 102 to the outside of the image forming apparatus 1.

A description is provided of a construction of an exhauster 69 according to a ninth embodiment.

Figure 13A:
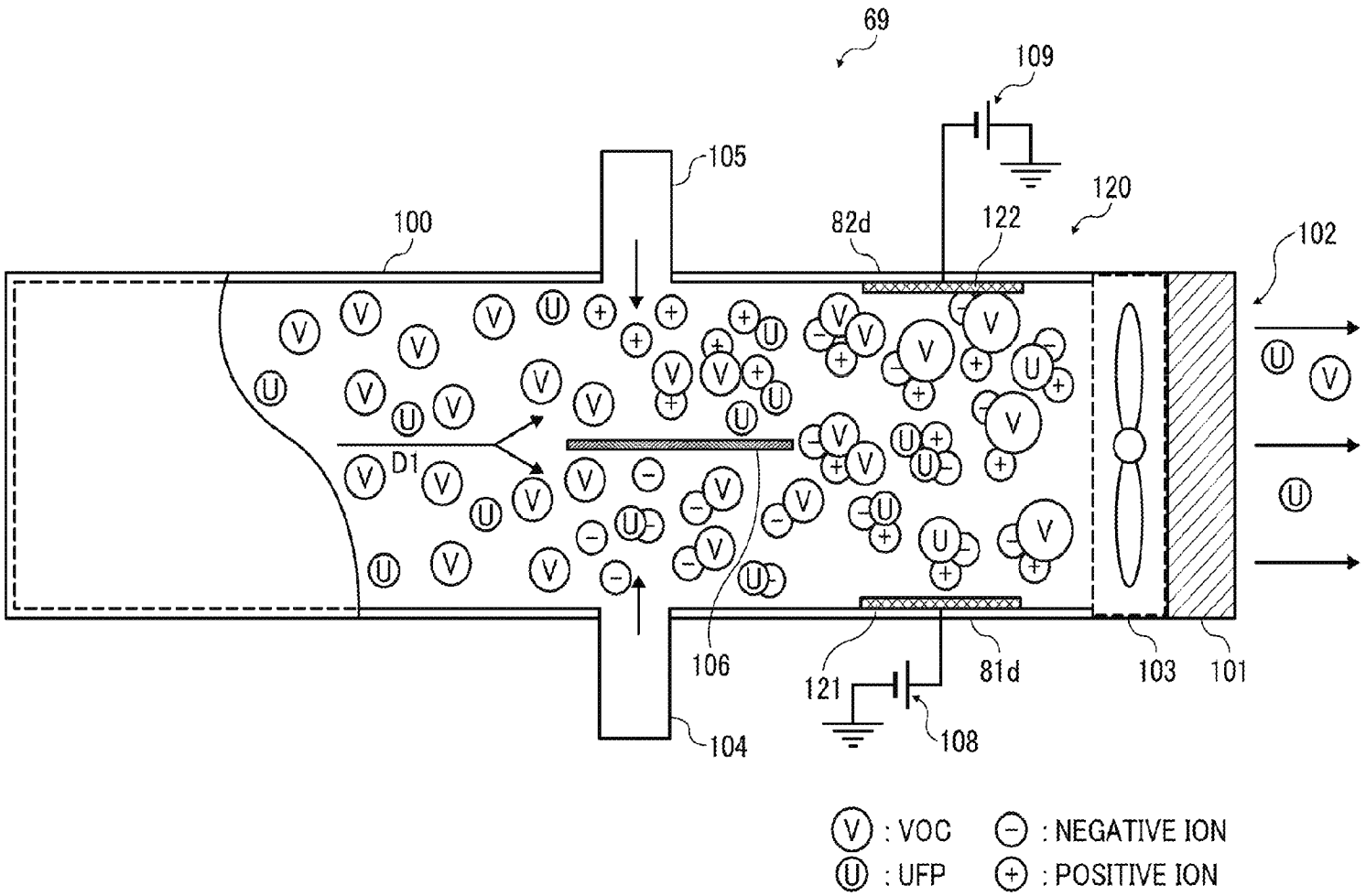
FIG. 13A is a plan view of an exhauster according to a ninth embodiment, which is incorporated in the image forming apparatus depicted in FIG. 1.
Figure 13B:
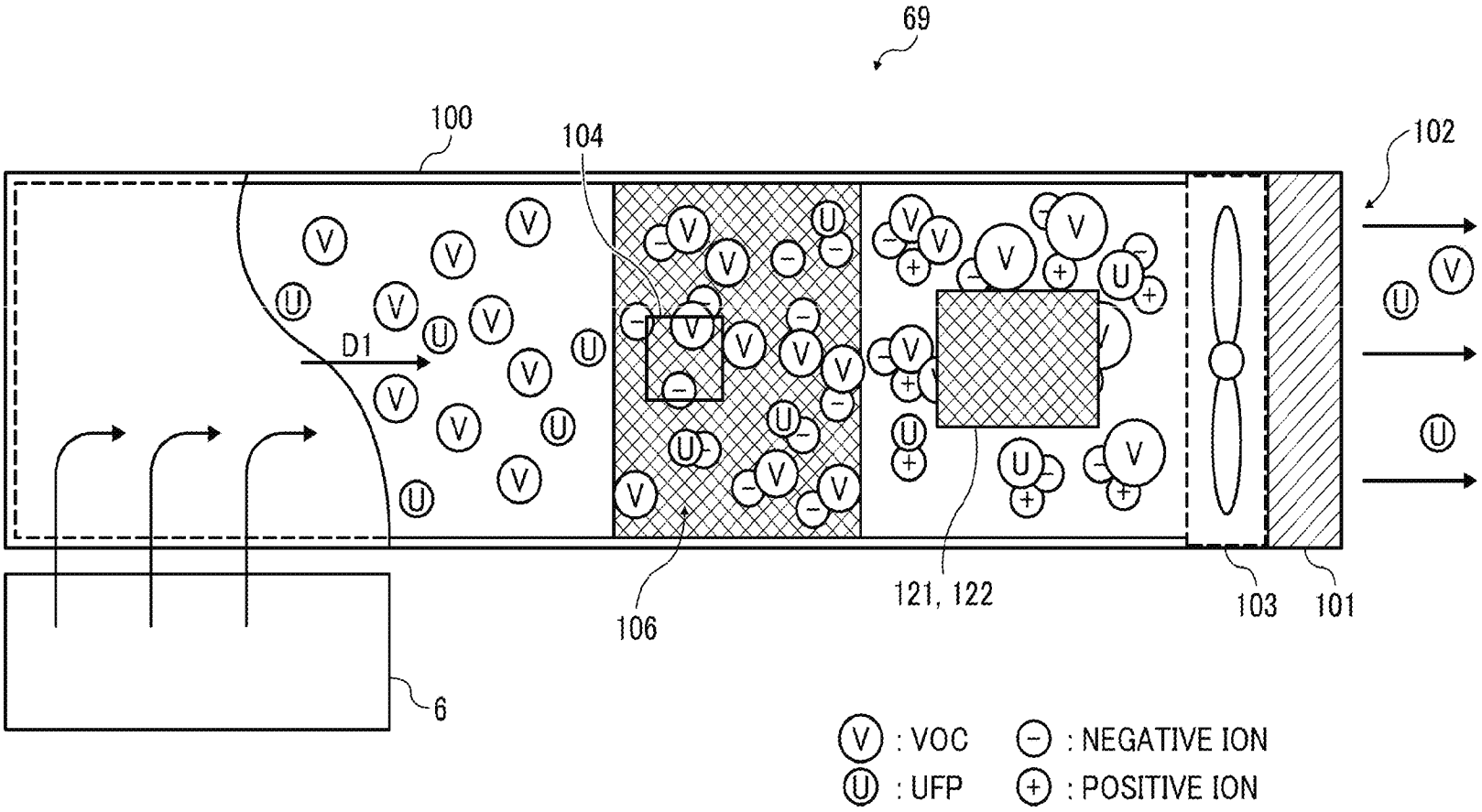
FIG. 13B is a side view of the exhauster depicted in FIG. 13A.

FIGS. 13A and 13B illustrate a diagram of the exhauster 69 according to the ninth embodiment. FIG. 13A is a plan view of the exhauster 69. FIG. 13B is a side view of the exhauster 69.

As illustrated in FIGS. 13A and 13B, in addition to the construction of the exhauster 63 according to the third embodiment depicted in FIGS. 6A and 6B, the exhauster 69 according to the ninth embodiment includes the counter electrode pair 120 disposed downstream from the negative ion generator 104 and the positive ion generator 105 in the air flow direction D1. The counter electrode pair 120 includes the positive electrode 121 and the negative electrode 122 disposed opposite the positive electrode 121.

According to the ninth embodiment, the partition 106 prevents the negative ion and the positive ion from colliding and attracting each other easily, thus suppressing neutralization, decrease in the number of the negative ions and the positive ions, and degradation in efficiency in ionization of the VOCs and the UFPs. Thereafter, the counter electrode pair 120, that is constructed of the positive electrode 121 and the negative electrode 122 mounted on the downstream walls 81*d* and 82*d* of the exhaust duct 100, respectively, electrostatically attracts and collects the VOCs and the UFPs not aggregated, decreasing the number of the VOCs and the UFPs emitted through the outlet 102 to the outside of the image forming apparatus 1.

Additionally, the partition 106 allows the negative ion generator 104 and the positive ion generator 105 to be disposed opposite each other at an identical position in the air flow direction D1 and aligned in the direction perpendicular to the air flow direction D1, thus saving space. The positive electrode 121 mounted on the downstream wall 81*d* of the exhaust duct 100 and the negative electrode 122 mounted on the downstream wall 82*d* of the exhaust duct 100 are parallel to the air flow direction D1. Accordingly, the positive electrode 121 and the negative electrode 122 are positioned flexibly to adjust an effective area according to a length of the air passage without disturbing airflow. The positive electrode 121 and the negative electrode 122 collect fine particles not aggregated and barely collected by the filter 101 before the fine particles reach the filter 101. Accordingly, the positive electrode 121 and the negative electrode 122 reduce a load imposed on the filter 101 and decrease the number of the VOCs and the UFPs emitted through the outlet 102 to the outside of the image forming apparatus 1.

A description is provided of a construction of an exhauster 70 according to a tenth embodiment.

Figure 14A:
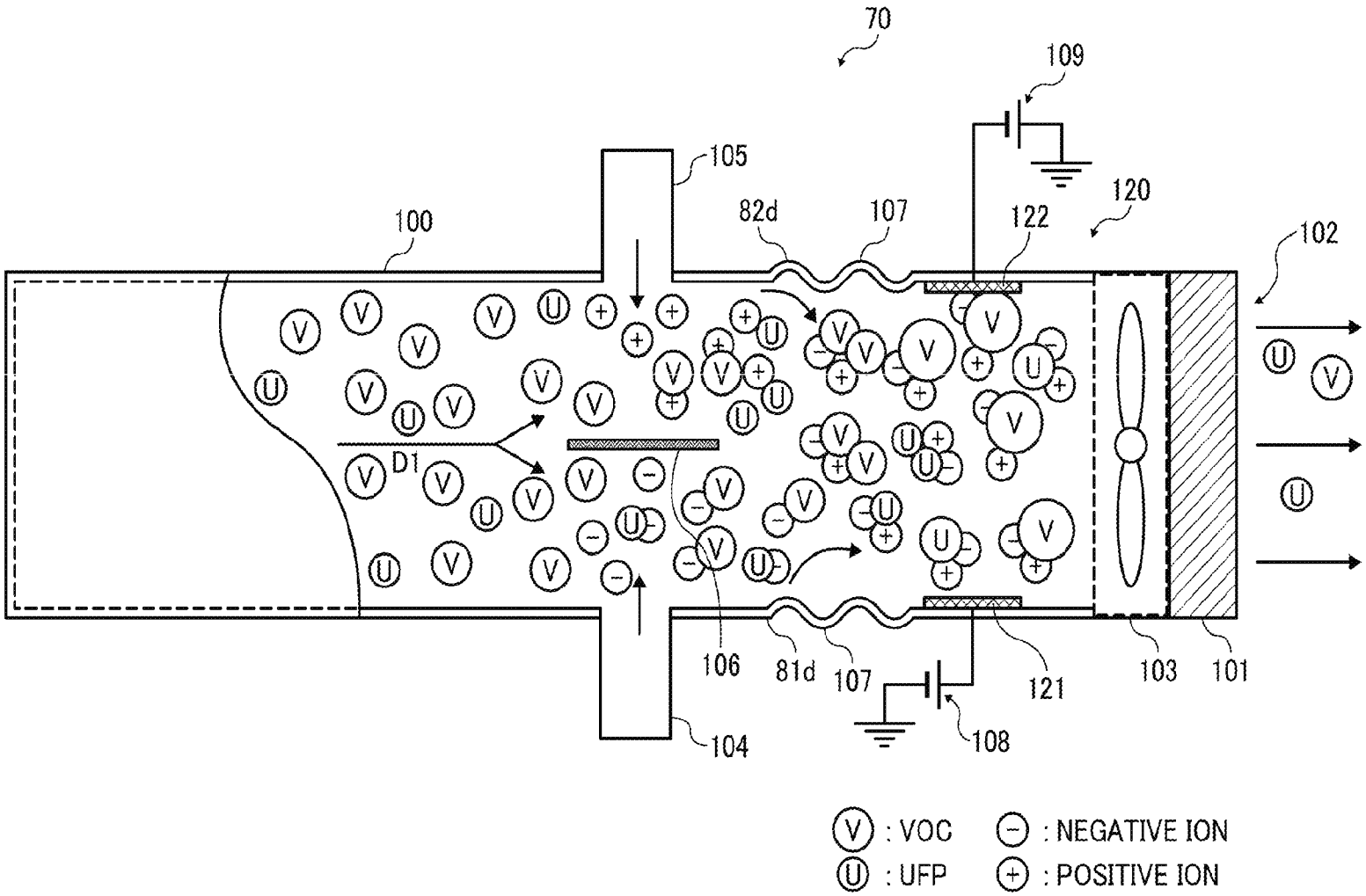
FIG. 14A is a plan view of an exhauster according to a tenth embodiment, which is incorporated in the image forming apparatus depicted in FIG. 1.
Figure 14B:
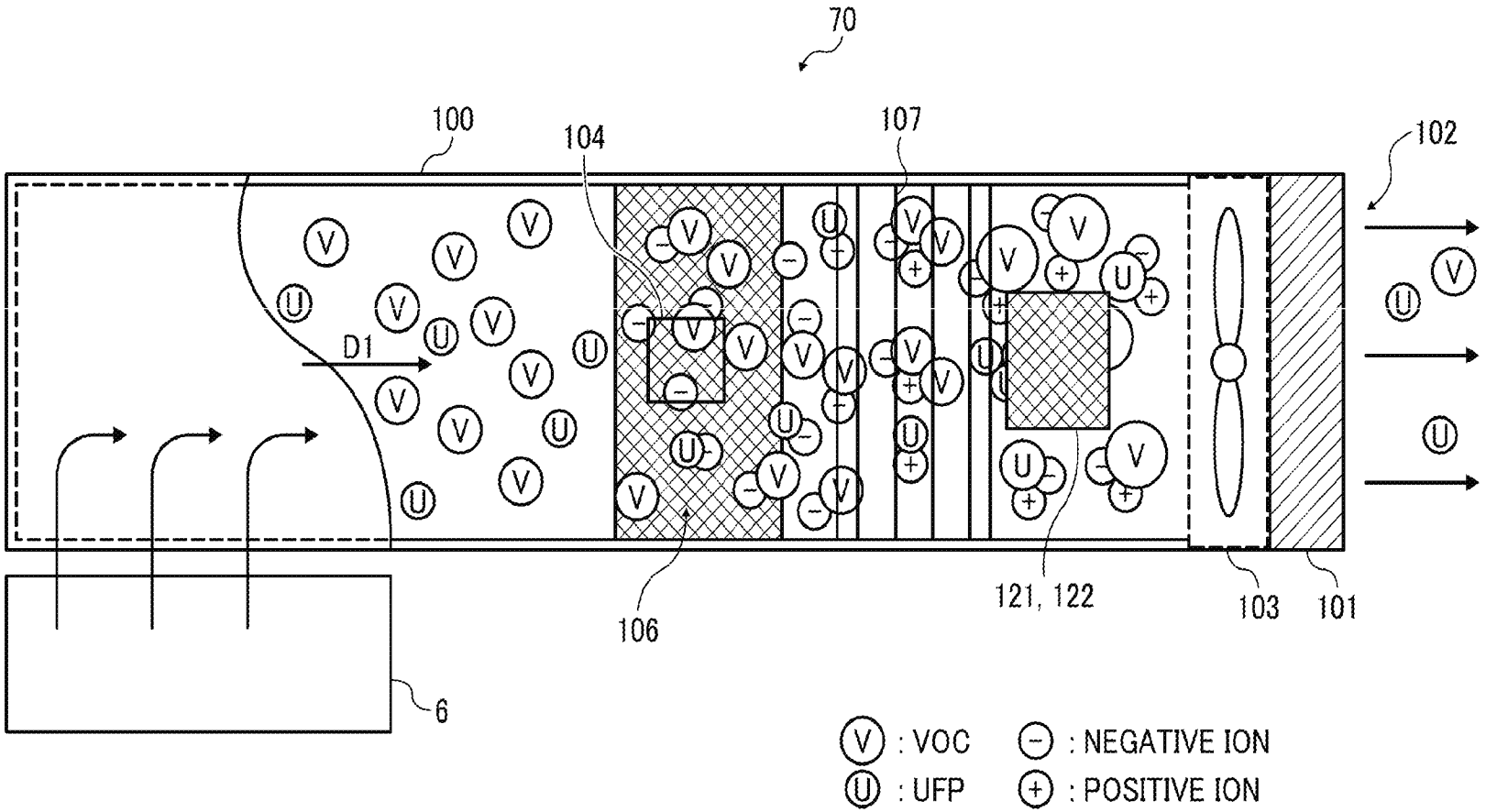
FIG. 14B is a side view of the exhauster depicted in FIG. 14A.

FIGS. 14A and 14B illustrate a diagram of the exhauster 70 according to the tenth embodiment. FIG. 14A is a plan view of the exhauster 70. FIG. 14B is a side view of the exhauster 70.

As illustrated in FIGS. 14A and 14B, in addition to the construction of the exhauster 69 according to the ninth embodiment depicted in FIGS. 13A and 13B, the exhauster 70 according to the tenth embodiment includes the downstream walls 81*d* and 82*d* that are not straight in cross-section and are disposed downstream from the negative ion generator 104 and the positive ion generator 105 in the air flow direction D1. Each of the downstream walls 81*d* and 82*d* of the exhaust duct 100 is wavy or uneven in cross-section. For example, each of the downstream walls 81*d* and 82*d* includes a wave or a projection and a recess. According to the tenth embodiment, compared to the ninth embodiment, the downstream walls 81*d* and 82*d* that are not straight agitate air inside the exhaust duct 100, enhancing efficiency in aggregation of the VOCs and the UFPs and decreasing the number of the VOCs and the UFPs emitted through the outlet 102 to the outside of the image forming apparatus 1.

A description is provided of a construction of an exhauster 71 according to an eleventh embodiment.

Figure 15A:
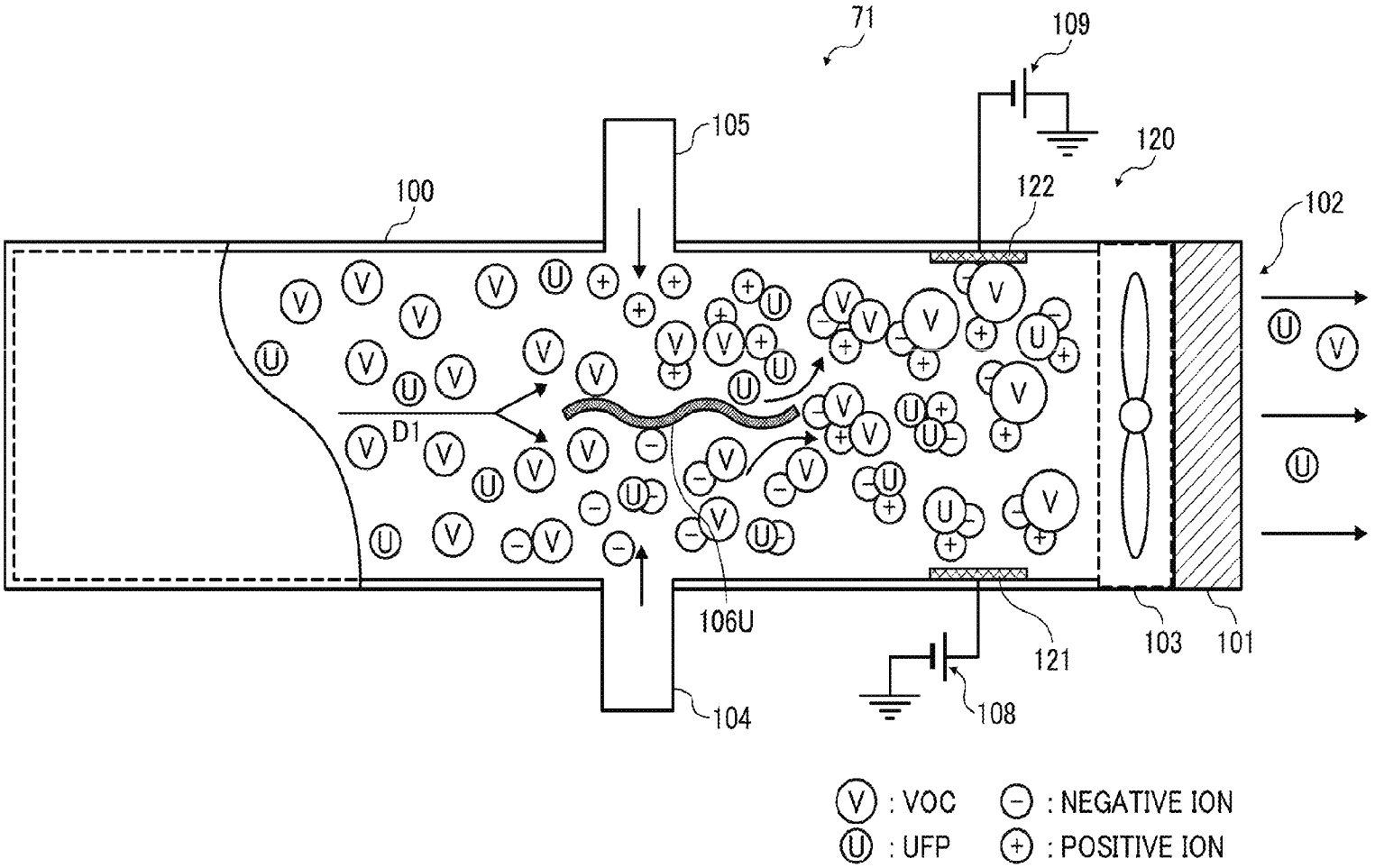
FIG. 15A is a plan view of an exhauster according to an eleventh embodiment, which is incorporated in the image forming apparatus depicted in FIG. 1.
Figure 15B:
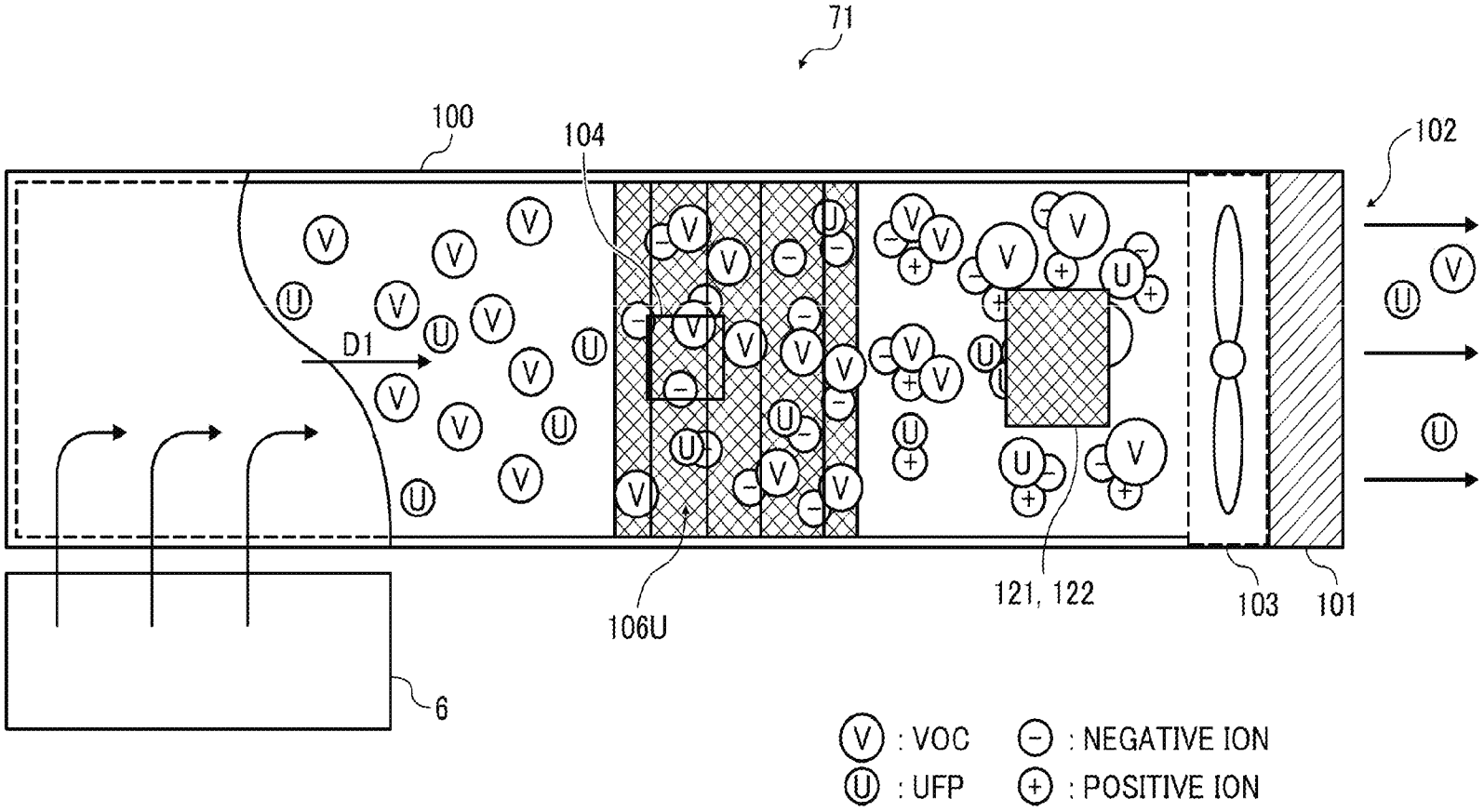
FIG. 15B is a side view of the exhauster depicted in FIG. 15A.

FIGS. 15A and 15B illustrate a diagram of the exhauster 71 according to the eleventh embodiment. FIG. 15A is a plan view of the exhauster 71. FIG. 15B is a side view of the exhauster 71.

As illustrated in FIGS. 15A and 15B, in addition to the construction of the exhauster 69 according to the ninth embodiment depicted in FIGS. 13A and 13B, the exhauster 71 according to the eleventh embodiment includes a partition 106U that is not straight in cross-section. The partition 106U is wavy or uneven in cross-section. For example, the partition 106U includes a wave or a projection and a recess. According to the eleventh embodiment, compared to the ninth embodiment, the partition 106U that is not straight agitates air inside the exhaust duct 100, enhancing efficiency in aggregation of the VOCs and the UFPs and decreasing the number of the VOCs and the UFPs emitted through the outlet 102 to the outside of the image forming apparatus 1.

A description is provided of a construction of an exhauster 72 according to a twelfth embodiment.

Figure 16A:
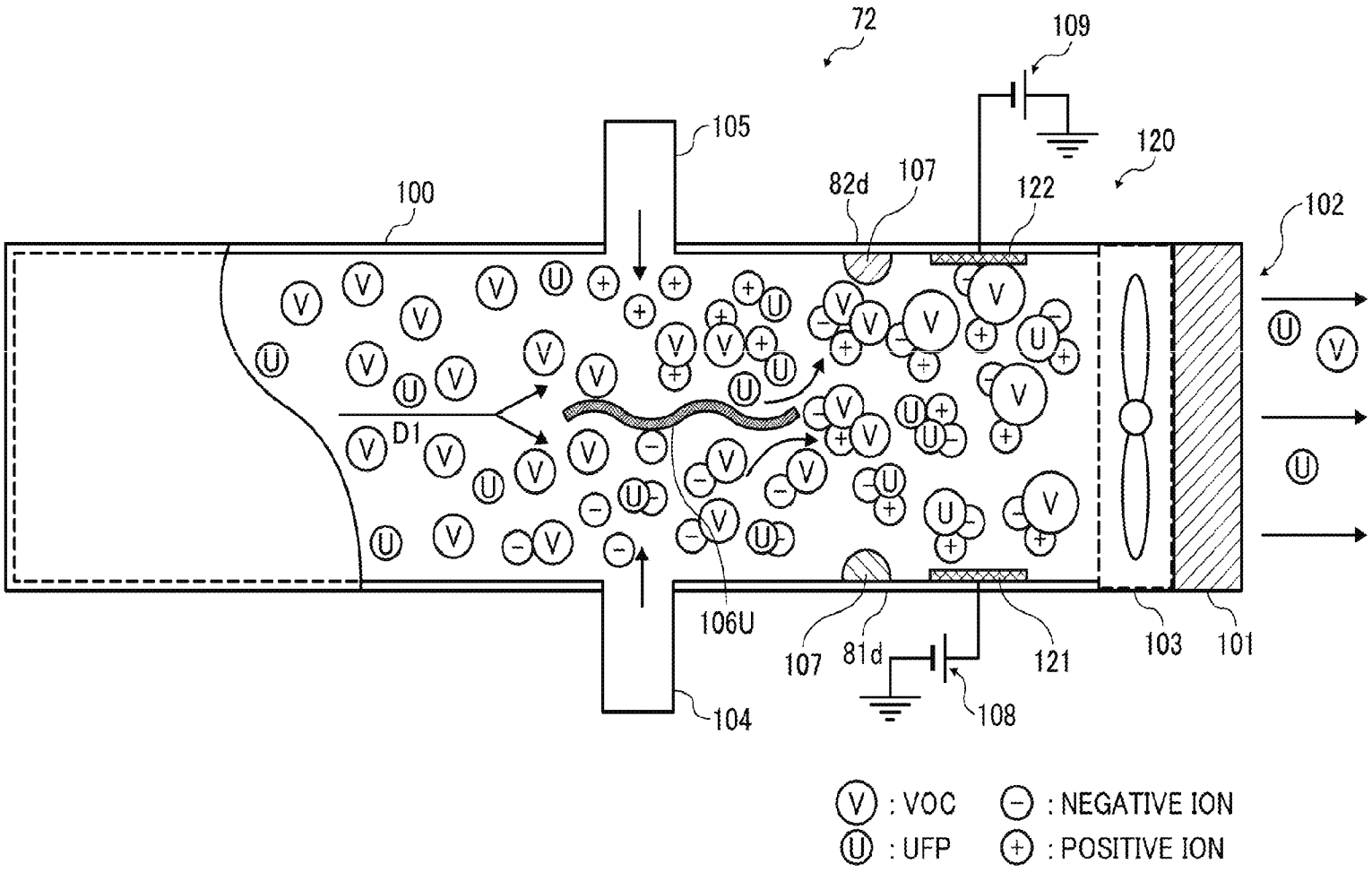
FIG. 16A is a plan view of an exhauster according to a twelfth embodiment, which is incorporated in the image forming apparatus depicted in FIG. 1.
Figure 16B:
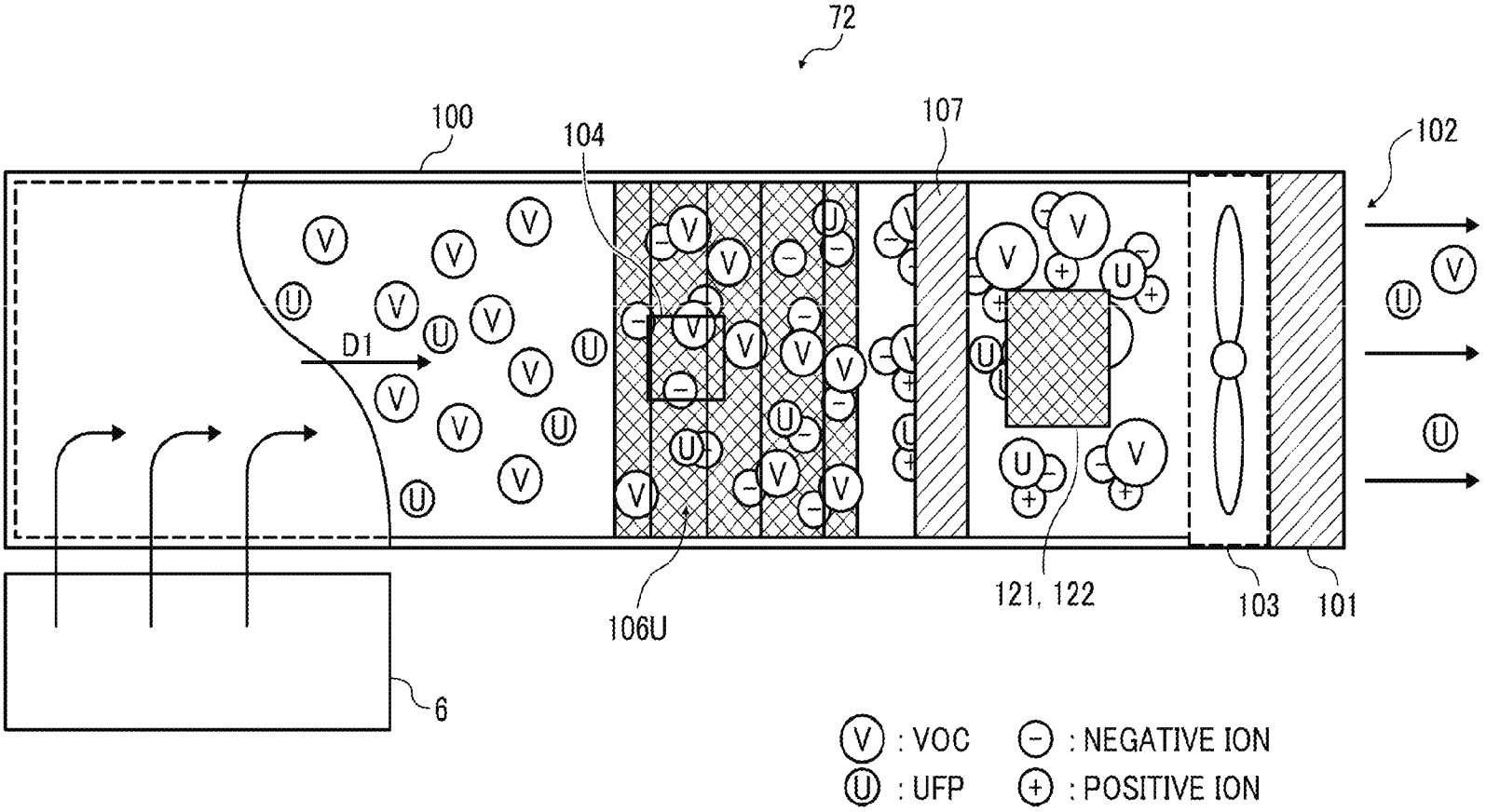
FIG. 16B is a side view of the exhauster depicted in FIG. 16A.

FIGS. 16A and 16B illustrate a diagram of the exhauster 72 according to the twelfth embodiment. FIG. 16A is a plan view of the exhauster 72. FIG. 16B is a side view of the exhauster 72.

As illustrated in FIGS. 16A and 16B, in addition to the construction of the exhauster 69 according to the ninth embodiment depicted in FIGS. 13A and 13B, the exhauster 72 according to the twelfth embodiment includes the partition 106U that is not straight in cross-section. The partition 106U is wavy or uneven in cross-section. For example, the partition 106U includes a wave or a projection and a recess. Additionally, each of the downstream walls 81*d* and 82*d* of the exhaust duct 100 is not straight. According to the twelfth embodiment, compared to the ninth embodiment, the partition 106U and the downstream walls 81*d* and 82*d* that are not straight agitate air in the air passage inside the exhaust duct 100, enhancing efficiency in aggregation of the VOCs and the UFPs and decreasing the number of the VOCs and the UFPs emitted through the outlet 102 to the outside of the image forming apparatus 1.

A description is provided of a construction of an exhauster 73 according to a thirteenth embodiment.

Figure 17A:
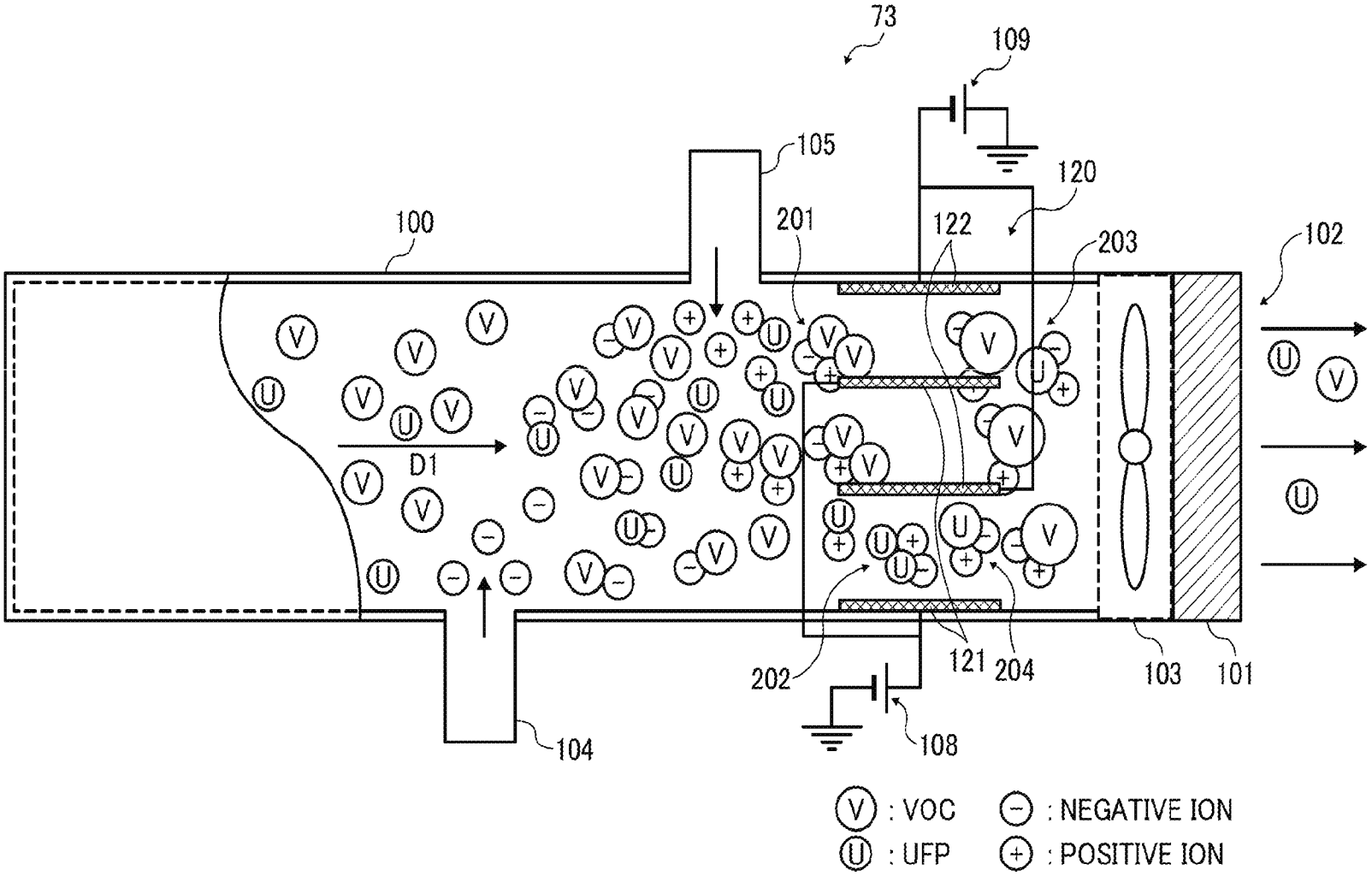
FIG. 17A is a plan view of an exhauster according to a thirteenth embodiment, which is incorporated in the image forming apparatus depicted in FIG. 1.
Figure 17B:
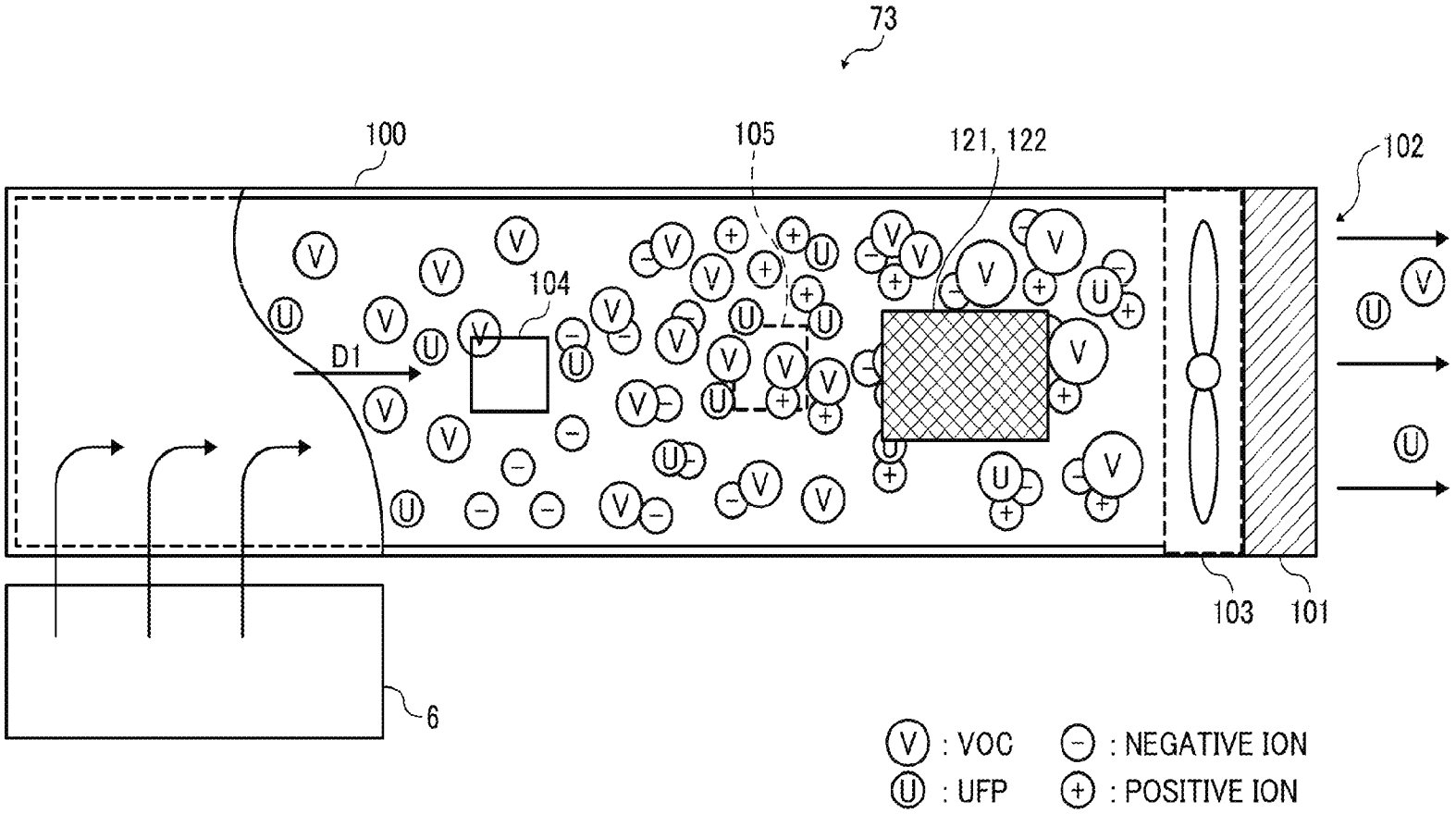
FIG. 17B is a side view of the exhauster depicted in FIG. 17A.

FIGS. 17A and 17B illustrate a diagram of the exhauster 73 according to the thirteenth embodiment. FIG. 17A is a plan view of the exhauster 73. FIG. 17B is a side view of the exhauster 73.

As illustrated in FIGS. 17A and 17B, the exhauster 73 according to the thirteenth embodiment includes a plurality of counter electrode pairs 120 each of which is constructed of the positive electrode 121 and the negative electrode 122 disposed opposite the positive electrode 121. For example, the exhauster 73 includes the counter electrode pair 120 constructed of the positive electrode 121 and the negative electrode 122 according to the seventh embodiment depicted in FIG. 11A and another counter electrode pair 120 constructed of the positive electrode 121 and the negative electrode 122. The plurality of counter electrode pairs 120 according to the thirteenth embodiment attains an electrode area that is greater than an electrode area of the single counter electrode pair 120 according to the seventh embodiment, thus collecting an increased number of the VOCs and the UFPs. Accordingly, the positive electrode 121 and the negative electrode 122 reduce a load imposed on the filter 101 and decrease the number of the VOCs and the UFPs emitted through the outlet 102 to the outside of the image forming apparatus 1.

A description is provided of a construction of an exhauster 74 according to a fourteenth embodiment.

Figure 18A:
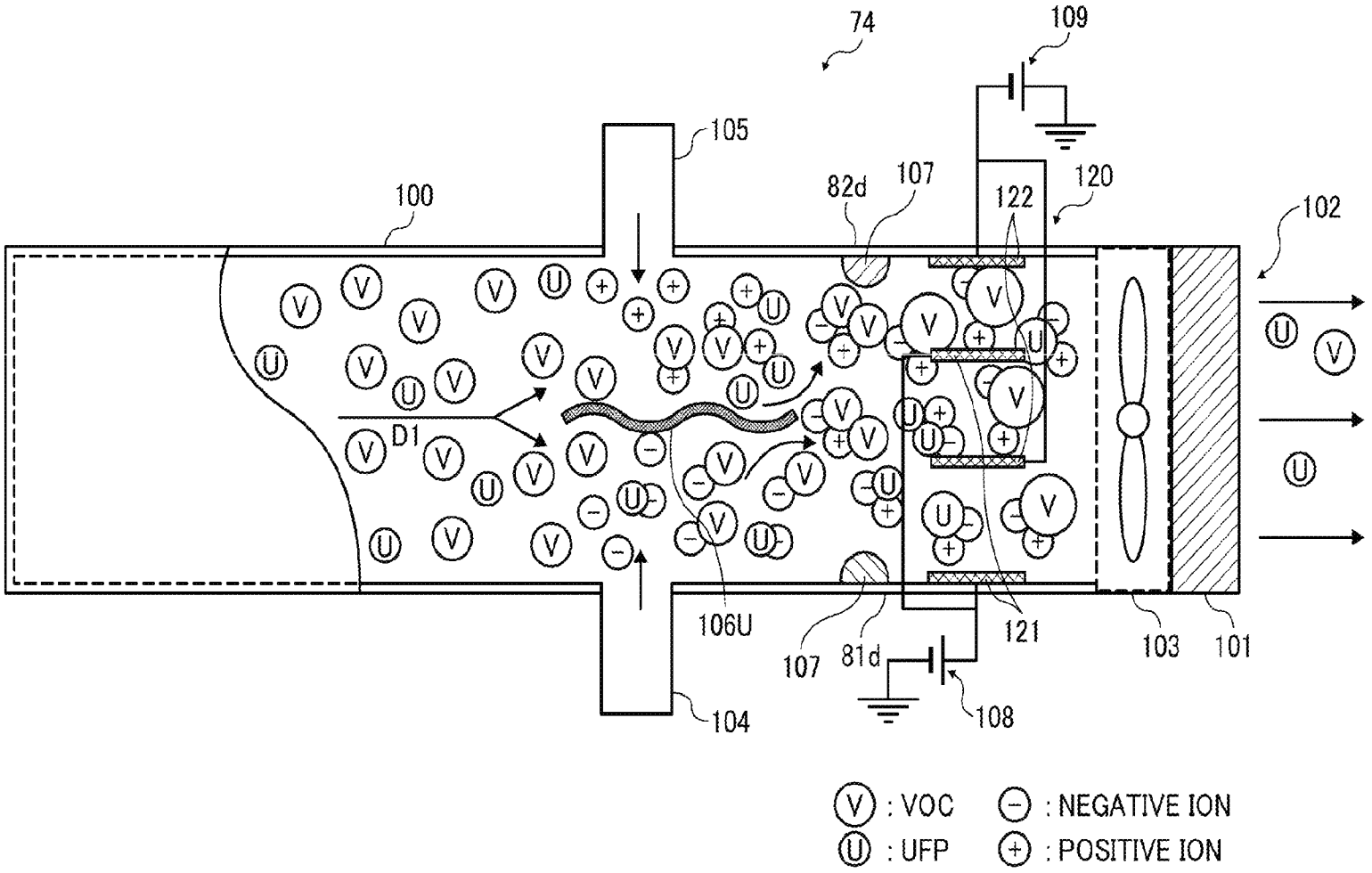
FIG. 18A is a plan view of an exhauster according to a fourteenth embodiment, which is incorporated in the image forming apparatus depicted in FIG. 1.
Figure 18B:
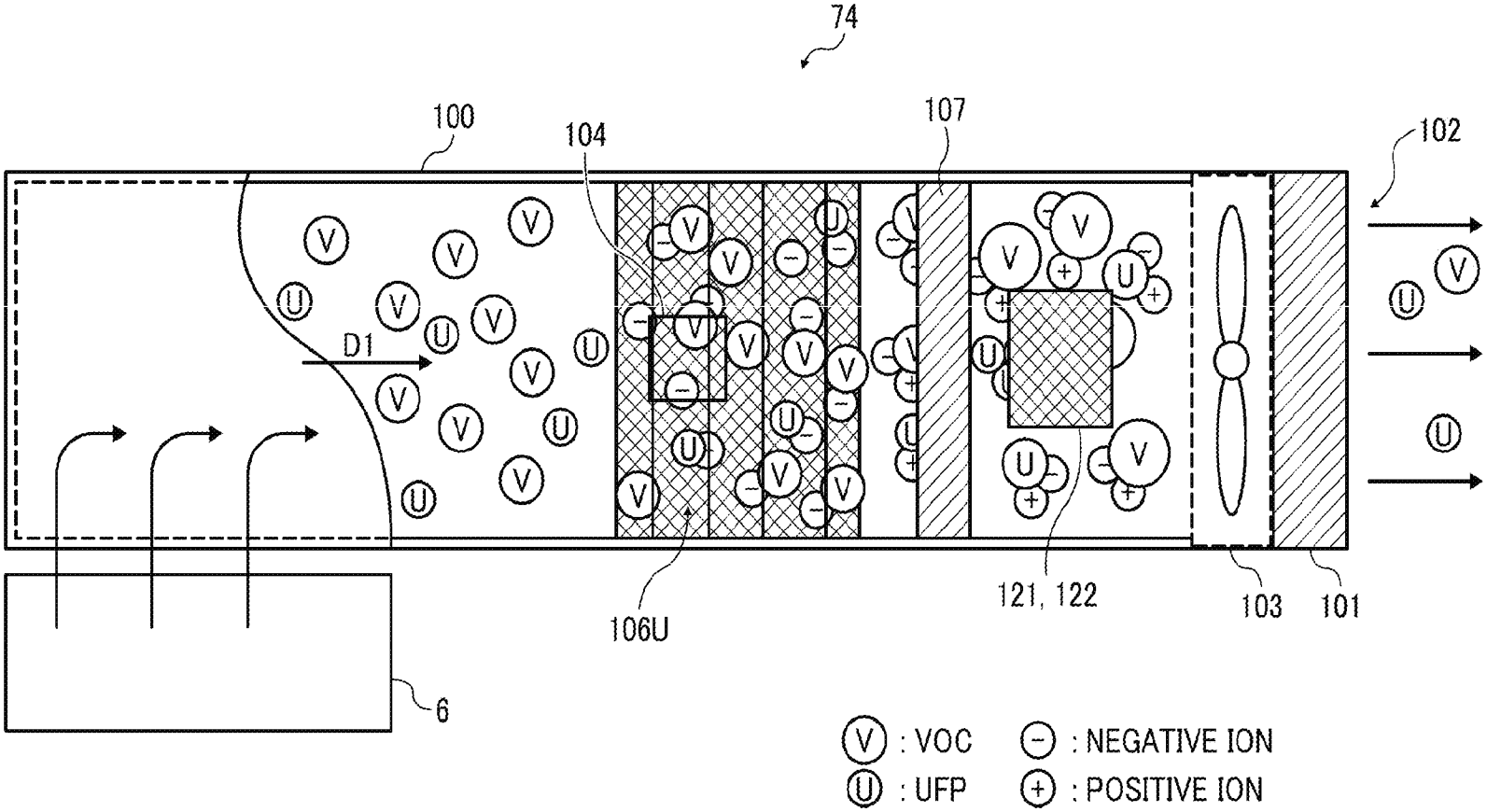
FIG. 18B is a side view of the exhauster depicted in FIG. 18A.

FIGS. 18A and 18B illustrate a diagram of the exhauster 74 according to the fourteenth embodiment. FIG. 18A is a plan view of the exhauster 74. FIG. 18B is a side view of the exhauster 74.

As illustrated in FIGS. 18A and 18B, the exhauster 74 according to the fourteenth embodiment, unlike the exhauster 67 according to the seventh embodiment depicted in FIGS. 11A and 11B, includes the plurality of counter electrode pairs 120 each of which is constructed of the positive electrode 121 and the negative electrode 122 disposed opposite the positive electrode 121. For example, the exhauster 74 includes the counter electrode pair 120 constructed of the positive electrode 121 and the negative electrode 122 according to the seventh embodiment depicted in FIG. 11A and another counter electrode pair 120 constructed of the positive electrode 121 and the negative electrode 122. The exhauster 74 further includes the partition 106U and the downstream walls 81*d* and 82*d* that are not straight. According to the fourteenth embodiment, compared to the seventh embodiment, the partition 106U and the downstream walls 81*d* and 82*d* that are not straight agitate air in the air passage inside the exhaust duct 100, enhancing efficiency in aggregation of the VOCs and the UFPs. Additionally, the plurality of counter electrode pairs 120 according to the fourteenth embodiment attains an electrode area that is greater than an electrode area of the single counter electrode pair 120 according to the seventh embodiment, thus collecting an increased number of the VOCs and the UFPs. Accordingly, the positive electrode 121 and the negative electrode 122 reduce a load imposed on the filter 101 and decrease the number of the VOCs and the UFPs emitted through the outlet 102 to the outside of the image forming apparatus 1.

A description is provided of an experiment examining effects of decrease in the number of the UFPs under various experimental conditions.

Figure 19:
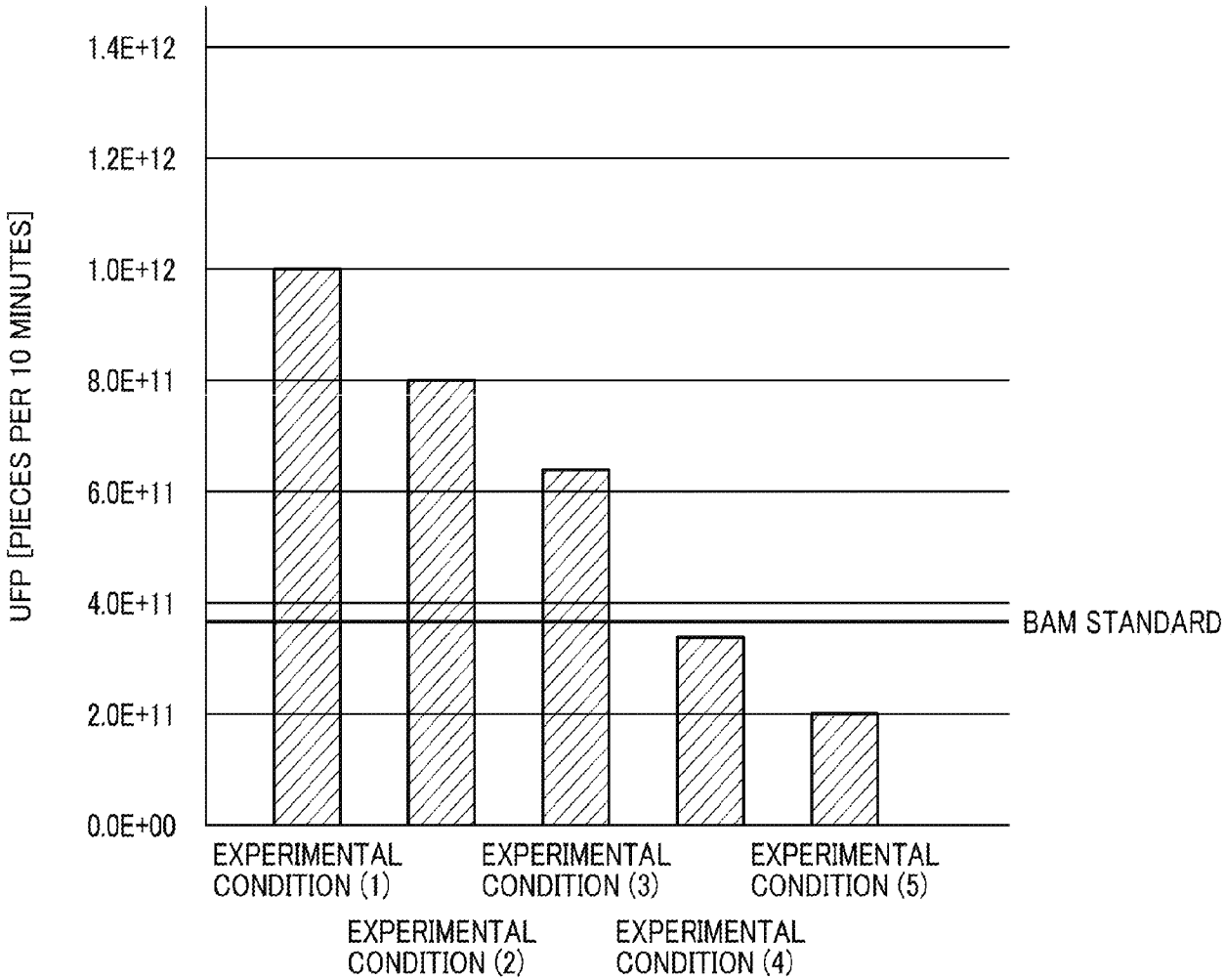
FIG. 19 is a graph illustrating a relation between the experimental condition and the number of ultra fine particles emitted from an experimental apparatus under experimental conditions (1) to (5)

FIG. 19 is a graph illustrating a relation between the experimental condition and the number of the UFPs to explain results of the experiment to measure the number of the UFPs.

A description is provided of an experimental method.

The experiment was conducted with a RICOH MP3554 modified machine as an experimental apparatus. An exhaust duct was modified. Since an amount of generation of the UFPs was small under a normal condition, a test was conducted at a fixing temperature increased forcibly. The experimental apparatus was located inside a chamber and activated for ten minutes in a test method defined under the BAM standard. The number of the UFPs was measured with the Fast Mobility Particle Sizer 3091 (FMPS™) spectrometer available from TSI Inc.

FIG. 19 illustrates experimental conditions (1) to (5) defined as below.

Under the experimental condition (1), no ion generator was used and no agitation was performed.

Under the experimental condition (2), a negative ion generator was used.

Under the experimental condition (3), a negative ion generator and a positive ion generator were used in a state in which the negative ion generator was disposed opposite the positive ion generator with no partition therebetween as illustrated in FIGS. 4A and 4B.

Under the experimental condition (4), a negative ion generator and a positive ion generator were used in a state in which the negative ion generator was disposed opposite the positive ion generator with a partition therebetween as illustrated in FIGS. 6A, 6B, 7A, and 7B.

Under the experimental condition (5), a negative ion generator and a positive ion generator were used in a state in which the negative ion generator was disposed opposite the positive ion generator with a partition therebetween and the partition had an agitator as illustrated in FIGS. 8A, 8B, 9A, and 9B.

As illustrated in FIG. 19, a comparison of the experimental condition (1) with the experimental conditions (2) to (5) indicates that the negative ion generator and the positive ion generator decrease the number of the UFPs. The experimental condition (4) indicates that the partition decreases the number of the UFPs further. The experimental condition (5) indicates that the agitator decreases the number of the UFPs further. The results of the experiment illustrated in FIG. 19 indicate that the BAM standard is satisfied under the experimental conditions (4) and (5).

A description is provided of verification of reasons why the number of the UFPs decreased.

Figure 20:
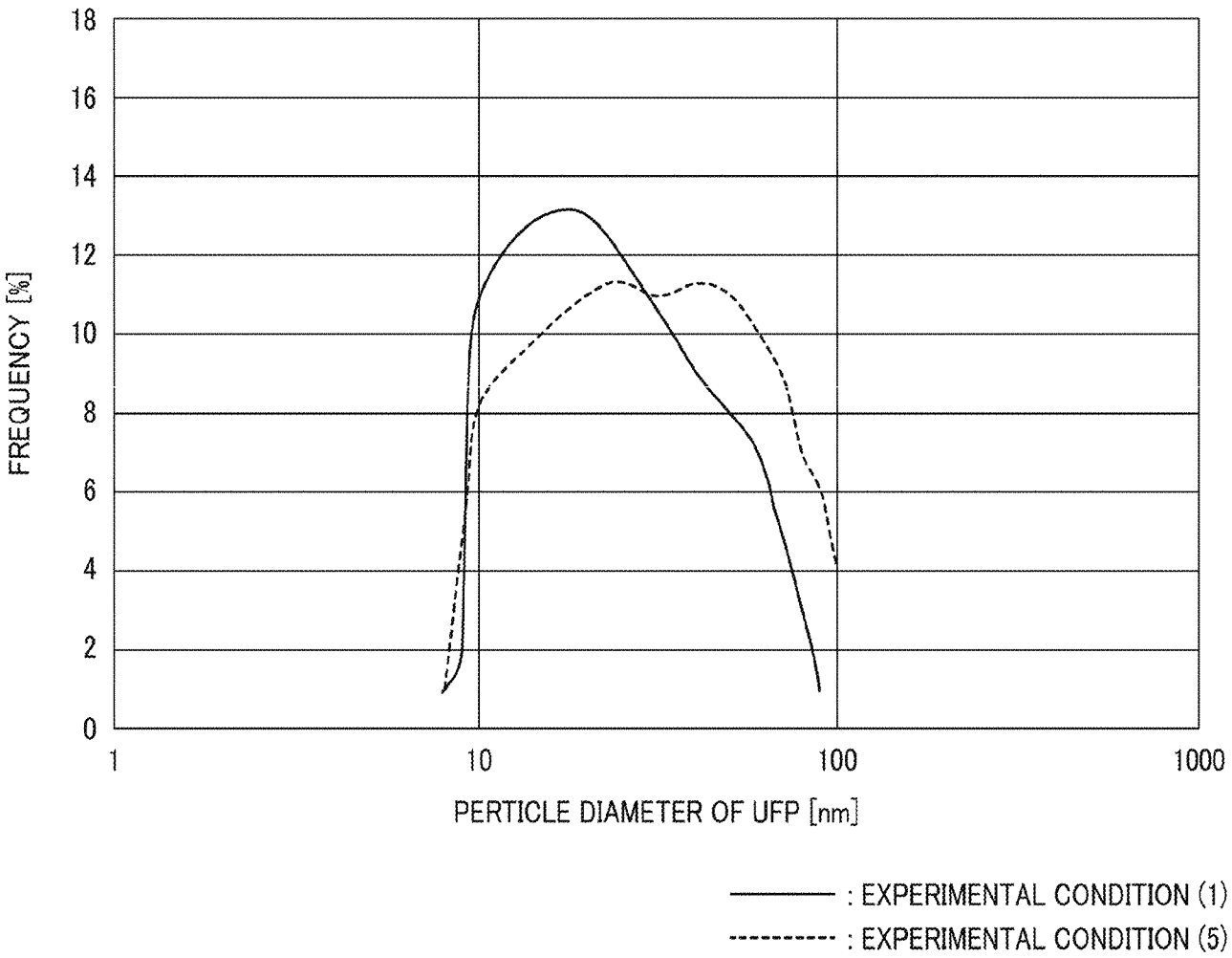
FIG. 20 is a graph illustrating a relation between the particle diameter of the ultra fine particle and the frequency to indicate the particle diameter distribution under the experimental conditions (1) and (5)

The Fast Mobility Particle Sizer 3091 (FMPS™ spectrometer measures not only the number of the UFPs but also a particle diameter distribution. FIG. 20 is a graph illustrating a relation between the particle diameter of the UFP and the frequency to indicate the particle diameter distribution under the experimental conditions (1) and (5). As illustrated in FIG. 20, compared to the experimental condition (1) with no ion generator and no agitator, the experimental condition (5) changes the particle diameter distribution of the UFPs and aggregates the UFPs after emission and agitation of negative ions and positive ions, thus decreasing the number of the UFPs emitted to an outside of the experimental apparatus.

A description is provided of another experiment examining effects of decrease in the number of the UFPs under various experimental conditions.

Figure 21:
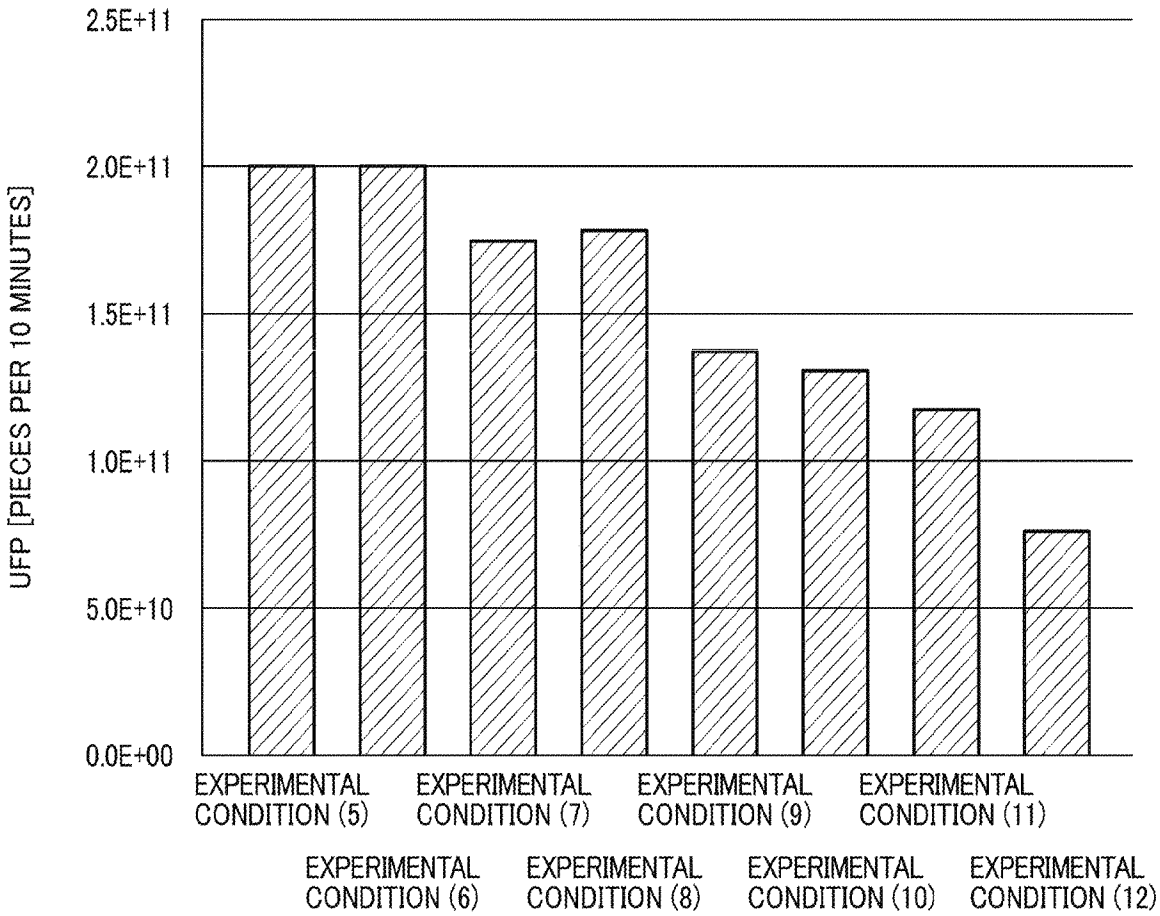
FIG. 21 is a graph illustrating a relation between the experimental condition and the number of ultra fine particles emitted from the experimental apparatus under experimental conditions (5) to (12).

FIG. 21 is a graph illustrating a relation between the experimental condition and the number of the UFPs to explain results of the experiment to measure the number of the UFPs. The experiment was conducted with the experimental method described above.

FIG. 21 illustrates a comparison of the number of the UFPs generated between experimental conditions (5) to (12) defined as below.

Under the experimental condition (5), a negative ion generator and a positive ion generator were used in a state in which the negative ion generator was disposed opposite the positive ion generator with a partition therebetween and the partition had an agitator as illustrated in FIGS. 8A, 8B, 9A, and 9B.

Under the experimental condition (6), a negative ion generator and a positive ion generator were used in a state in which the negative ion generator was disposed opposite the positive ion generator with a distance therebetween, that is, the positive ion generator was shifted from the negative ion generator in an air flow direction, and a non-straight agitator was disposed downstream from the negative ion generator and the positive ion generator in the air flow direction inside an exhaust duct as illustrated in FIGS. 10A and 10B.

Under the experimental condition (7), a negative ion generator and a positive ion generator were used in a state in which the negative ion generator was disposed opposite the positive ion generator with a distance therebetween, that is, the positive ion generator was shifted from the negative ion generator in an air flow direction, and a counter electrode pair was disposed downstream from the negative ion generator and the positive ion generator in the air flow direction inside an exhaust duct as illustrated in FIGS. 11A and 11B.

Under the experimental condition (8), a negative ion generator and a positive ion generator were used in a state in which the negative ion generator was disposed opposite the positive ion generator with a partition therebetween and a counter electrode pair was disposed downstream from the negative ion generator and the positive ion generator in an air flow direction in an exhaust duct as illustrated in FIGS. 13A and 13B.

Under the experimental condition (9), a negative ion generator and a positive ion generator were used in a state in which the negative ion generator was disposed opposite the positive ion generator with a partition therebetween, a non-straight agitator was disposed downstream from the negative ion generator and the positive ion generator in an air flow direction inside an exhaust duct, and a counter electrode pair was disposed downstream from the non-straight agitator in the air flow direction inside the exhaust duct as illustrated in FIGS. 14A and 14B.

Under the experimental condition (10), a negative ion generator and a positive ion generator were used in a state in which the negative ion generator was disposed opposite the positive ion generator with a distance therebetween, that is, the positive ion generator was shifted from the negative ion generator in an air flow direction, and a plurality of counter electrode pairs was disposed downstream from the negative ion generator and the positive ion generator in the air flow direction inside an exhaust duct as illustrated in FIGS. 17A and 17B.

Under the experimental condition (11), a negative ion generator and a positive ion generator were used in a state in which the negative ion generator was disposed opposite the positive ion generator with a non-straight partition therebetween, a non-straight agitator was disposed downstream from the negative ion generator and the positive ion generator in an air flow direction inside an exhaust duct, and a counter electrode pair was disposed downstream from the non-straight agitator in the air flow direction inside the exhaust duct as illustrated in FIGS. 16A and 16B.

Under the experimental condition (12), a negative ion generator and a positive ion generator were used in a state in which the negative ion generator was disposed opposite the positive ion generator with a non-straight partition therebetween, a non-straight agitator was disposed downstream from the negative ion generator and the positive ion generator in an air flow direction inside an exhaust duct, and a plurality of counter electrode pairs was disposed downstream from the non-straight agitator in the air flow direction inside the exhaust duct as illustrated in FIGS. 18A and 18B.

Referring to FIG. 21, a description is provided of results (a) to (d) of the experiment.

First, a description is provided of the result (a).

The experimental conditions (7) and (8) involving the counter electrode pair attained attraction of charged particles and therefore decreased the number of the UFPs compared to the experimental conditions (5) and (6) involving the partition and the non-straight agitator disposed inside the exhaust duct.

A description is provided of the result (b).

The experimental condition (9) involving the counter electrode pair and the non-straight agitator disposed inside the exhaust duct attained agitation of an air current, facilitating aggregation of the UFPs and attraction of the UFPs to the counter electrode pair and thereby decreasing the number of the UFPs emitted to the outside of the experimental apparatus.

A description is provided of the result (c).

The experimental condition (11) involving the counter electrode pair, the non-straight agitator disposed inside the exhaust duct, and the non-straight partition enhanced efficiency in agitation of an air current, aggregation of the UFPs, and attraction of the UFPs to the counter electrode pair, thus decreasing the number of the UFPs emitted to the outside of the experimental apparatus.

A description is provided of the result (d).

The experimental conditions (10) and (12) involving the plurality of counter electrode pairs arranged in parallel enhanced efficiency in agitation and increased an attraction area of the counter electrode pairs where the counter electrode pairs attracted the UFPs, decreasing the number of the UFPs emitted to the outside of the experimental apparatus further. Similar effects may be attained when an area of the single counter electrode pair increases.

The embodiments described above are one example and attain advantages below in a plurality of aspects.

A description is provided of advantages of the image forming apparatus 1 in an aspect A.

As illustrated in FIGS. 1 and 4A, an image forming apparatus (e.g., the image forming apparatus 1) includes an exhaust duct (e.g., the exhaust duct 100), a positive ion generator (e.g., the positive ion generator 105), and a negative ion generator (e.g., the negative ion generator 104). The exhaust duct guides air inside the image forming apparatus to an outside of the image forming apparatus. The positive ion generator emits a positive ion into the exhaust duct. The negative ion generator emits a negative ion into the exhaust duct. The positive ion generator is shifted from the negative ion generator in an air flow direction (e.g., the air flow direction D1) of the air moving inside the exhaust duct or a direction perpendicular to the air flow direction.

A description is provided of a configuration of the first comparative image forming apparatus described above.

The first comparative image forming apparatus includes a positive ion generator and a negative ion generator that sandwich an air passage inside an exhaust duct. If the positive ion generator and the negative ion generator sandwich the air passage inside the exhaust duct at an identical position in an air flow direction of air moving inside the exhaust duct, a positive ion generated by the positive ion generator and a negative ion generated by the negative ion generator may be mixed easily immediately after the positive ion and the negative ion are emitted to the exhaust duct. Accordingly, before the positive ion and the negative ion adhere to volatile organic compounds and ultra fine particles contained in the air moving through the exhaust duct, the positive ion and the negative ion may attract each other and may bond to each other. Consequently, bonding of the positive ion and the negative ion may decrease the number of positive ions and negative ions inside the exhaust duct. Since the density of volatile organic compounds emitted into the exhaust duct is substantially high, the positive ions or the negative ions adhere to and charge the volatile organic compounds easily. Hence, even if the number of the positive ions or the negative ions decreases slightly, the positive ions or the negative ions adhere to the volatile organic compounds and the volatile organic compounds are bonded to each other by the Coulomb force, decreasing the number of the volatile organic compounds readily.

Conversely, the density of ultra fine particles emitted into the exhaust duct is low. For example, the density of ultra fine particles is not greater than one thousandth of the density of volatile organic compounds. A particle diameter of a ultra fine particle is smaller than a particle diameter of a volatile organic compound. A surface area of a ultra fine particle is smaller than a surface area of a volatile organic compound. Accordingly, positive ions or negative ions do not adhere to and charge the ultra fine particles easily. Consequently, if the number of the positive ions or the negative ions decreases, the number of the charged ultra fine particles decreases. The number of ultra fine particles bonded to each other does not increase and therefore the number of ultra fine particles does not decrease easily.

To address those circumstances, the image forming apparatus in the aspect A reduces attraction and bonding between positive ions and negative ions and thereby prevents the number of the positive ions or the negative ions from decreasing due to bonding between the positive ions and the negative ions. Accordingly, the positive ions or the negative ions sufficiently adhere to and properly charge volatile organic compounds and ultra fine particles contained in air moving through the exhaust duct. Consequently, the number of the volatile organic compounds and the ultra fine particles that are charged increases.

The number of the volatile organic compounds and the ultra fine particles that are bonded to each other by the Coulomb force increases. The number of the volatile organic compounds and the ultra fine particles inside the exhaust duct decreases. Accordingly, the positive ions or the negative ions sufficiently adhere to and properly charge ultra fine particles to which the positive ions or the negative ions do not adhere easily because the particle diameter and the surface area of the ultra fine particle are relatively small. Consequently, the number of the ultra fine particles bonded to each other in the image forming apparatus in the aspect A increases compared to the first comparative image forming apparatus, decreasing the number of ultra fine particles inside the exhaust duct. Hence, the image forming apparatus in the aspect A decreases the number of ultra fine particles generated inside the image forming apparatus and emitted to the outside of the image forming apparatus effectively.

A description is provided of advantages of the image forming apparatus in an aspect B.

As illustrated in FIGS. 1 and 4A, an image forming apparatus (e.g., the image forming apparatus 1) includes an exhaust duct (e.g., the exhaust duct 100), a positive ion generator (e.g., the positive ion generator 105), and a negative ion generator (e.g., the negative ion generator 104). The exhaust duct guides air inside the image forming apparatus to an outside of the image forming apparatus. The positive ion generator emits a positive ion into the exhaust duct. The negative ion generator emits a negative ion into the exhaust duct. As illustrated in FIGS. 6A, 7A, 8A, 9A, 13A, 14A, 15A, 16A, and 18A, the positive ion generator is disposed opposite the negative ion generator via a partition (e.g., the partitions 106, 106S, 106T, and 106U) interposed between the positive ion generator and the negative ion generator.

The partition divides an inside of the exhaust duct into a positive ion region (e.g., the positive ion passage 84) into which the positive ion generator emits the positive ion and a negative ion region (e.g., the negative ion passage 83) into which the negative ion generator emits the negative ion. Accordingly, the positive ion does not bond to the negative ion, preventing the number of the positive ions and the negative ions from decreasing due to bonding. The positive ion or the negative ion sufficiently adheres to and properly charges a volatile organic compound and a ultra fine particle contained in air moving through the exhaust duct. Consequently, the number of the volatile organic compounds and the ultra fine particles that are charged increases. The number of the volatile organic compounds and the ultra fine particles that are bonded to each other by the Coulomb force increases. The number of the volatile organic compounds and the ultra fine particles inside the exhaust duct decreases.

A description is provided of advantages of the image forming apparatus in an aspect C.

In the aspect A or B, at least one of the positive ion generator and the negative ion generator includes a plurality of ion generators.

The plurality of ion generators emits the positive ions and the negative ions into the exhaust duct in an increased number, increasing the frequency at which the positive ions or the negative ions adhere to volatile organic compounds and ultra fine particles. Accordingly, the volatile organic compounds and the ultra fine particles that are positively charged are bonded by the Coulomb force to the volatile organic compounds and the ultra fine particles that are negatively charged into an aggregation. Consequently, the number of the volatile organic compounds and the ultra fine particles that are emitted to the outside of the image forming apparatus decreases substantially.

A description is provided of advantages of the image forming apparatus in an aspect D.

In the aspect B, as illustrated in FIG. 8A, the partition is not straight. The partition includes a non-straight portion (e.g., a non-straight face 106S1) being disposed inside the exhaust duct and extending in an air flow direction (e.g., the air flow direction D1). As air moves inside the exhaust duct, the air contacts and moves over the non-straight portion.

The non-straight portion of the partition agitates air moving through each of the positive ion region and the negative ion region that are defined by the partition. Accordingly, the positive ions or the negative ions readily adhere to and properly charge volatile organic compounds and ultra fine particles contained in air moving through the exhaust duct. Consequently, the volatile organic compounds and the ultra fine particles are bonded to each other by the Coulomb force in an increased number, enhancing efficiency in aggregation and substantially decreasing the number of the volatile organic compounds and the ultra fine particles that are emitted to the outside of the image forming apparatus.

A description is provided of advantages of the image forming apparatus in an aspect E.

In the aspect D, as illustrated in FIG. 9A, the non-straight portion is a downstream portion (e.g., the downstream portion 106Td) disposed at a downstream end of the partition in the air flow direction.

The downstream portion of the partition agitates air containing the volatile organic compounds and the ultra fine particles that pass the partition in the air flow direction, further enhancing efficiency in aggregation of the volatile organic compounds and the ultra fine particles.

A description is provided of advantages of the image forming apparatus in an aspect F.

In the aspect A or B, as illustrated in FIG. 10A, the exhaust duct includes a downstream wall (e.g., the downstream walls 81*d* and 82*d*) disposed downstream from the positive ion generator and the negative ion generator in the air flow direction. The downstream wall is not straight.

The downstream wall agitates air moving through the exhaust duct, facilitating proper adhesion of the positive ions and the negative ions to the volatile organic compounds and the ultra fine particles contained in the air and proper charging of the volatile organic compounds and the ultra fine particles. Accordingly, the volatile organic compounds and the ultra fine particles are bonded to each other by the Coulomb force in an increased number, enhancing efficiency in aggregation and substantially decreasing the number of the volatile organic compounds and the ultra fine particles that are emitted to the outside of the image forming apparatus.

A description is provided of advantages of the image forming apparatus in an aspect G.

In any aspect of the aspects A to F, as illustrated in FIG. 11A, the downstream wall includes a first wall (e.g., the downstream wall 81*d*) and a second wall (e.g., the downstream wall 82*d*) that mount a counter electrode pair (e.g., the counter electrode pair 120) disposed downstream from the positive ion generator and the negative ion generator in the air flow direction. The counter electrode pair includes a positive electrode (e.g., the positive electrode 121) mounted on the first wall and a negative electrode (e.g., the negative electrode 122) mounted on the second wall and disposed opposite the positive electrode. The positive electrode and the negative electrode are made of metal or conductive resin. A voltage is applied to the positive electrode and the negative electrode.

The counter electrode pair mounted on the downstream wall of the exhaust duct electrostatically attracts and collects the volatile organic compounds and the ultra fine particles that are ionized. The counter electrode pair collects fine particles not aggregated and barely collected by a filter before the fine particles reach the filter. Accordingly, the positive electrode and the negative electrode reduce a load imposed on the filter and decrease the number of the volatile organic compounds and the ultra fine particles emitted to the outside of the image forming apparatus. Since the positive electrode is mounted on the first wall and the negative electrode is mounted on the second wall, the positive electrode and the negative electrode are parallel to the air passage and the air flow direction. Accordingly, the positive electrode and the negative electrode are positioned flexibly to adjust an effective area according to a length of the air passage without disturbing airflow.

A description is provided of advantages of the image forming apparatus in an aspect H.

In the aspect G, as illustrated in FIG. 17A, a plurality of counter electrode pairs is parallel to the air flow direction.

The plurality of counter electrode pairs collects fine particles in an increased number. Accordingly, the positive electrode and the negative electrode reduce a load imposed on the filter and decrease the number of the volatile organic compounds and the ultra fine particles emitted to the outside of the image forming apparatus.

A description is provided of advantages of the image forming apparatus in an aspect I.

In the aspect G or H, the counter electrode pair is removably mounted on the first wall and the second wall.

The counter electrode pair is replaced with new one or cleaned, reducing a load imposed on the filter and increasing the life of the filter.

A description is provided of advantages of the image forming apparatus in an aspect J.

In any one of the aspects A to I, as illustrated in FIG. 4A, a fan (e.g., the fan 103) is disposed inside the exhaust duct. The fan creates a current of air from an inside to an outside of the image forming apparatus. The positive ion generator and the negative ion generator are driven synchronously with driving of the fan.

Accordingly, while air moves through the exhaust duct, the positive ion generator emits a positive ion or the negative ion generator emits a negative ion, reducing redundant driving of the positive ion generator and the negative ion generator and increasing the life of the positive ion generator and the negative ion generator.

The above-described embodiments are illustrative and do not limit the present disclosure. Thus, numerous additional modifications and variations are possible in light of the above teachings. For example, elements and features of different illustrative embodiments may be combined with each other and substituted for each other within the scope of the present invention.

Any one of the above-described operations may be performed in various other ways, for example, in an order different from the one described above.

What is claimed is:

1. An image forming apparatus comprising:

an exhaust duct to guide air inside the image forming apparatus to an outside of the image forming apparatus;

a positive ion generator to emit a positive ion into the exhaust duct;

a negative ion generator to emit a negative ion into the exhaust duct, the negative ion generator being shifted from the positive ion generator in one of an air flow direction of the air moving inside the exhaust duct and a direction perpendicular to the air flow direction; and a counter electrode pair disposed downstream from the positive ion generator and the negative ion generator in the air flow direction, wherein the counter electrode pair includes a positive electrode applied with a positive voltage, and a negative electrode applied with a negative voltage and disposed opposite the positive electrode, wherein the exhaust duct includes a downstream wall disposed wall disposed downstream from the positive ion generator and the negative ion generator in the airflow direction, and wherein the downstream wall includes a first wall mounting the positive electrode, and a second wall mounting the negative electrode.

2. The image forming apparatus according to claim 1, wherein at least one of the positive ion generator and the negative ion generator includes a plurality of ion generators.

3. The image forming apparatus according to claim 1, further comprising a partition interposed between the positive ion generator and the negative ion generator.

4. The image forming apparatus according to claim 3, wherein the partition extends in the air flow direction and the direction perpendicular to the air flow direction.

5. The image forming apparatus according to claim 3, wherein the partition includes a non-straight portion extending in the air flow direction, the non-straight portion over which the air moves.

6. The image forming apparatus according to claim 5, wherein the non-straight portion includes a downstream portion of the partition in the air flow direction.

7. The image forming apparatus according to claim 6, wherein the downstream portion is triangular.

8. The image forming apparatus according to claim 1, wherein the downstream wall is not straight.

9. The image forming apparatus according to claim 1, wherein the downstream wall includes a projection.

10. The image forming apparatus according to claim 1, wherein the downstream wall is wavy.

11. The image forming apparatus according to claim 1, wherein the positive electrode and the negative electrode are made of one of metal and conductive resin.

12. The image forming apparatus according to claim 1, further comprising another counter electrode pair being parallel to the air flow direction.

13. The image forming apparatus according to claim 1, wherein the counter electrode pair is removably mounted on the first wall and the second wall.

14. The image forming apparatus according to claim 1, further comprising a projection disposed upstream from the counter electrode pair in the air flow direction.

15. The image forming apparatus according to claim 1, further comprising a fan, disposed inside the exhaust duct, to create a current of the air from an inside to the outside of the image forming apparatus, wherein the positive ion generator and the negative ion generator are driven synchronously with driving of the fan.

16. The image forming apparatus according to claim 1, wherein the positive ion generator is disposed opposite the negative ion generator in the direction perpendicular to the air flow direction.

* * * * *